United States Patent [19]

Ueda et al.

[11] Patent Number: 4,914,009

[45] Date of Patent: Apr. 3, 1990

[54] PROCESS FOR FORMING DIRECT POSITIVE COLOR IMAGE COMPRISING THE USE OF BLEACH ACCELERATORS

[75] Inventors: Shinji Ueda; Tatsuo Heki; Noriyuki Inoue, all of Minami-Ashigara, Japan

[73] Assignee: Fuji Photo Film Co., Ltd., Minami-Ashigara, Japan

[21] Appl. No.: 66,615

[22] Filed: Jun. 26, 1987

[30] Foreign Application Priority Data

Jun. 30, 1986 [JP] Japan ..... 61-153902

[51] Int. Cl.[4] ..... G03C 7/02; G03C 7/42

[52] U.S. Cl. ..... 430/378; 430/393; 430/406; 430/409; 430/411; 430/430; 430/445; 430/489; 430/547; 430/607; 430/611

[58] Field of Search ..... 430/378, 393, 430, 406, 430/409, 411, 445, 489, 547, 607, 611

[56] References Cited

U.S. PATENT DOCUMENTS

| | | | |
|---|---|---|---|
| 3,772,020 | 11/1973 | Smith | 430/393 |
| 4,094,683 | 6/1978 | Tsujino et al. | 96/95 |
| 4,115,122 | 9/1978 | Adachi et al. | 96/76 |
| 4,245,037 | 6/1981 | Tsujino et al. | 430/559 |
| 4,255,511 | 3/1981 | Hirano et al. | 430/217 |
| 4,294,919 | 10/1981 | Tsujino et al. | 430/559 |
| 4,358,528 | 11/1982 | Takagi et al. | 430/251 |
| 4,374,923 | 2/1983 | Hirano et al. | 430/410 |
| 4,377,635 | 3/1983 | Mifune et al. | 430/564 |
| 4,395,478 | 7/1983 | Hoyer | 430/378 |
| 4,444,871 | 4/1984 | Miyaoka et al. | 430/378 |
| 4,540,655 | 9/1985 | Takagi et al. | 430/410 |
| 4,546,070 | 10/1985 | Kishimoto et al. | 430/393 |
| 4,550,070 | 10/1985 | Miyasaka et al. | 430/202 |
| 4,717,647 | 1/1988 | Abe et al. | 430/385 |

FOREIGN PATENT DOCUMENTS 62-80649 4/1987 Japan .

*Primary Examiner*—Paul R. Michl
*Assistant Examiner*—Patrick A. Doudy
*Attorney, Agent, or Firm*—Burns, Doane, Swecker & Mathis

[57] ABSTRACT

The present invention relates to a process for forming a direct positive color image, wherein bleaching time is reduced and color reproduction is not deteriorated. According to the present invention, there is provided a process for forming a direct positive color image comprising exposing a photosensitive material comprising, on a support, at least one photographic emulsion layer containing previously unfogged internal latent image-type silver halide grains and a color image-forming coupler, color-developing the same in the presence of a nucleating agent and/or fogging light, and then processing it with a processing solution having a bleaching effect, characterized in that a bleaching accelerator is incorporated into the processing bath having the bleaching effect or a pre-processing bath, or said bleaching accelerator is incorporated into the photosensitive material.

6 Claims, No Drawings

PROCESS FOR FORMING DIRECT POSITIVE COLOR IMAGE COMPRISING THE USE OF BLEACH ACCELERATORS

FIELD OF THE INVENTION

The present invention relates to a direct positive silver halide photosensitive material and a process for forming an image by exposing the photosensitive material and subjecting it to a surface developing process to form a direct positive image.

BACKGROUND OF THE INVENTION

A photographic process for forming a direct positive image without necessitating any reversal processing step or negative film is well known.

Known processes for forming a positive image by using a direct positive silver halide photosensitive material except for special ones can be mainly classified into two types from the viewpoint of practical utilization as will be described below.

In one type of the processes, a previously fogged silver halide emulsion is developed to produce a direct positive image by breaking the fog nuclei (latent image) in the exposed region using solarization or according to Harschel effects.

In the other type of the processes, an un-fogged silver halide emulsion of internal latent image-type is imagewisely exposed, and the surface development is conducted after the fogging process or during the fogging process, to obtain a direct positive image.

The term "silver halide photographic emulsion of internal latent iamge-type" indicates a silver halide photographic emulsion having a photosensitive nucleus mainly inside the silver halide grains so that the latent image is formed mainly inside the grains by the exposure.

As compared with the former processes, the latter processes have generally a higher sensitivity and, therefore, they are suitably used when a high sensitivity is required. The process of the present invention belongs to the latter.

Various techniques have been known in this technical field. Typical examples of them are described in U.S. Pat. Nos. 2,592,250, 2,466,957, 2,497,875, 2,588,982, 3,317,322, 3,761,266, 3,761,276 and 3,796,577 and British Pat. Nos. 1,151,363, 1,150,553 and 1,011,062.

According to these known processes, photosensitive materials having a relatively high sensitivity as compared with other ones of the direct positive type can be prepared.

The details of the mechanism of the formation of the direct positive image are described in, for example, T. H. James, "The Theory of The Photographic Process", 4th Edition, Chapter 7, pages 182 to 193 and U.S. Pat. No. 3,761,276.

Namely, it is generally considered that fog nuclei are formed selectively on only the surface of the silver halide grains in an unexposed region by the surface desensitization effect due to so-called internal latent image formed inside the silver halide grains by the first imagewise exposure and then an ordinary surface development process is conducted to form the photographic image (direct positive image) in the unexposed region.

As processes for selectively forming the fog nuclei, there have been known a "photo-fogging" process wherein the second exposure is conducted over the whole surface of the photosensitive layer (see, for example, British Pat. No. 1,151,363) and a "chemical fogging process" wherein a nucleating agent is used. The latter process is described in, for example, Research Disclosure, Vol. 151, No. 15162 (published in Nov., 1976), pages 76 to 78.

A direct positive color image is formed by imagewise exposure of a direct positive silver halide photosensitive material followed by (1) a color development conducted in the presence of a nucleating agent and/or fog light and then (2) desilverization process.

It is known that the desilverization can be accelerated by using a bleach-fixing solution containing both ferric complex salt of aminopolycarboxylic acid and thiosulfate as described in German Pat. No. 866,605. However, when the ferric complex salt of aminopolycarboxylic acid having an essentially weak oxidizing power (bleaching power) is combined with the thiosulfate having a reducing power, the bleaching power of the former is seriously deteriorated. Various processes have been proposed for overcoming the defect of the bleach-fixing solution. They include, for example, a process wherein an iodide or bromide is added as described in British Pat. No. 926,569 and Japanese patent publication No. 53-11,854, and a process wherein triethanolamine is used so that the reaction system contains a high concentration of the ferric complex salt of aminopolycarboxylic acid as described in Japanese Patent Public Disclosure No. 48-95,834. However, the effects of these processes are yet insufficient and unpractical.

The bleach-fixing solution has, as well as the defect of the insufficient desilverization power, another defect that a cyan dye formed in the color development is reduced into a leuco dye and the color development is reduced into a leuco dye and the color reproducibility is seriously deteriorated. Although it has been known that this defect can be overcome by elevating the pH of the bleach-fixing solution as described in U.S. Pat. No. 3,773,510, this process is impractical because the bleaching power is weakened as the pH is elevated. In addition, the nucleating agent is unstable under such a high pH condition and it is liable to be oxidized by air. A process wherein the leuco dye is oxidized with a potassium ferricyanide bleaching solution to recover the cyan dye again after the bleach-fixing is described in U.S. Pat. No. 3,189,452. However, potassium ferricyanide is causative of an environmental pollution as described above and even when the bleaching is conducted after the bleach-fixing, the effect of reducing the amount of remaining silver is scarcely exhibited.

On the other hand, as a process for increasing the bleaching power of the ferric complex salt of aminopolycarboxylate when a photosensitive material comprising a negative emulsion is bleached, a process has been proposed wherein a bleaching accelerator selected from various ones is added to a bleaching bath, bleach-fixing bath or preprocessing bath.

The bleaching accelerators include, for example, mercapto compounds described in U.S. Pat. No. 3,893,858, British Pat. No. 138,842 and Japanes Patent Public Disclosure No. 53-141623; compounds having a disulfido bond as described in Japanese Patent Public Disclosure No. 53-95630; thiazolidine derivatives as described in Japanese Patent Publication No. 53-9854; isothiourea derivatives as described in Japanese Patent Public Disclosure No. 53-94927, thiourea deriviatives as described in Japanese Patent Public Disclosure Nos. 45-8506 and 49-26586; thioamido compounds as described in Japanese Patent Public Disclosure No. 49-42349; and dithiocarbamates as described in Japanese Patent Public Disclosure No. 55-26506.

Although some of the bleaching accelerators have the effect of accelerating the bleaching of the color photosensitive materials comrpising a negative emulsion, the effect of them on the color photosensitive materials comprising a positive emulsion is not always satisfactory and they do not satisfy the requirement of reducing the processing time.

SUMMARY OF THE INVENTION

An object of the present invention is to provide a process for forming a direct positive color image, wherein the bleaching time can be reduced and the color reproduction is not deteriorated. The above object can be achieved by a process for forming a direct positive color image comprising exposing a photosensitive material comprising, on a support, at least one photographic emulsion layer containing previously unfogged internal latent image-type silver halide grains and a color image-forming coupler, color-developing the same in the presence of a nucleating agent/or fogging light, and then processing it with a processing solution having a bleaching effect, characterized in that a bleaching accelerator is incorporated in a processing bath having the bleaching effect or a pre-processing bath or the bleaching accelerator is incorporated in the photosensitive material.

DETAILED DESCRIPTION OF THE INVENTION

Now, the present invention will be explained in detail below.

The bleaching accelerator to be contained in the bleaching bath in the present invention is selected from compounds having a mercapto group or disulfido bond, thiazoline derivatives, thiourea derivatives, and isothiourea derivatives. Any compounds can be used so long as they have bleaching-accelerating effects. Among them, those of the following general formulae (I) to (VII) are preferred:

General formula (I):

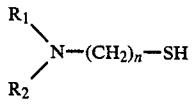

wherein $R_1$ and $R_2$ may be the same or different and each represent a hydrogen atom or a substituted or unsubstituted lower alkyl group (preferably having 1 to 5 carbon atoms; particularly methyl, ethyl or propyl group) or an acyl group (preferably having 1 to 3 carbon atoms; such as acetyl or propionyl group), and n represents an integer of 1 to 3, or $R_1$ and $R_2$ may be combined to form a ring.

$R_1$ and $R_2$ are particularly preferably a substituted or unsubstituted lower alkyl group.

The substituents of $R_1$ and $R_2$ include, for example, a hydroxyl group, carboxyl group, sulfo group, and amino group.

General formula (II):

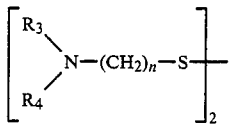

wherein $R_3$ and $R_4$ have the same meaning as that of $R_1$ and $R_2$ in the general formula (I) and n is an integer of 1 to 3, or $R_3$ and $R_4$ may be combined to form a ring.

$R_3$ and $R_4$ are particularly preferably a substituted or unsubstituted lower alkyl group.

The substituents of $R_3$ and $R_4$ include, for example, hydroxyl group, carboxyl group, sulfo group, and amino group.

General formula (III):

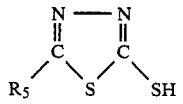

General formula (IV):

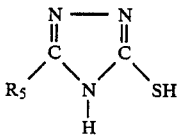

General formula (V):

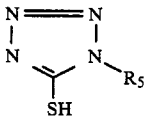

wherein $R_5$ represents a hydrogen atom, halogen atom (such as chlorine or bromine atom), amino group, substituted or unsubstituted lower alkyl group (having preferably 1 to 5 carbon atoms; particularly preferably methyl, ethyl or propyl group) or amino group having an alkyl group (such as methylamino, ethylamino, dimethylamino or diethylamino group).

The substituents of $R_5$ include, for example, a hydroxyl group, carboxyl group, sulfo group and amino group.

General formula (VI):

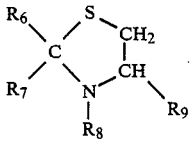

wherein $R_6$ and $R_7$ may be the same or different and each represent a hydrogen atom, substituted or unsubstituted alkyl group (preferably a lower alkyl group such as methyl, ethyl or propyl group), substituted or unsubstituted phenyl group or substituted or unsubstituted hetercyclic group (in particular, a heterocyclic group having at least one hetero atom such as nitrogen, oxygen or sulfur atom; for example, a pyridine ring, thiophene ring, thiazolidine ring, benzooxazole ring, benzotriazole ring, thiazole ring, or imidazole ring), $R_8$ represents a hydrogen atom or a substituted or unsubstituted lower alkyl group (preferably having 1 to 3 carbon atoms; such as methyl or ethyl group).

The substituents of $R_6$ to $R_8$ include, for example, a hydroxyl group, carboxyl group, sulfo group, amino group and lower alkyl groups.

$R_9$ represents a hydrogen atom or carboxyl group.

General formula (VII):

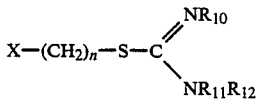

wherein $R_{10}$, $R_{11}$ and $R_{12}$ may be the same or different and each represents a hydrogen atom or lower alkyl group (preferably having 1 to 3 carbon atoms; such as methyl or ethyl group) or $R_{10}$ and $R_{11}$ or $R_{12}$ may be combined to form a ring, and X represents an amino group, sulfonic acid group or carboxyl group which may have a substituent (such as a lower alkyl group, e.g. methyl group, or an alkoxyalkyl group, e.g. acetoxymethyl group).

Particularly preferably, $R_{10}$ to $R_{12}$ are a hydrogen atom, methyl group or ethyl group, and X is an amino group or dialkylamino group.

Examples of the compounds of the general formulae (I) to (VII) are as follows:

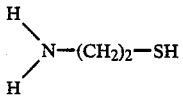
(I)-(1)

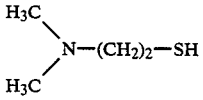
(I)-(2)

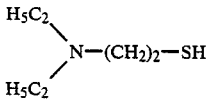
(I)-(3)

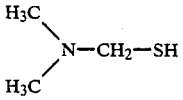
(I)-(4)

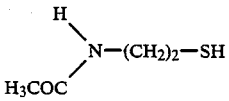
(I)-(5)

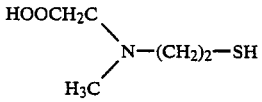
(I)-(6)

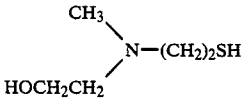
(I)-(7)

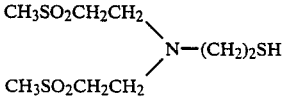
(I)-(8)

-continued

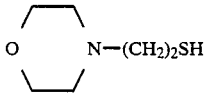
(I)-(9)

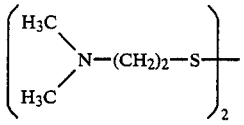
(II)-(1)

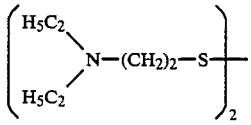
(II)-(2)

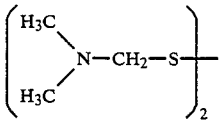
(II)-(3)

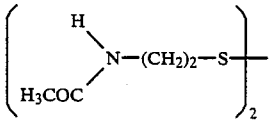
(II)-(4)

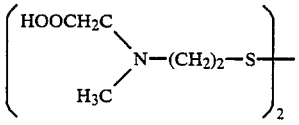
(II)-(5)

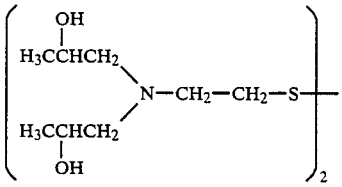
(II)-(6)

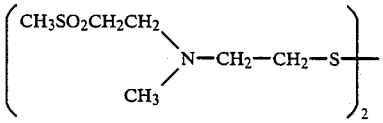
(II)-(7)

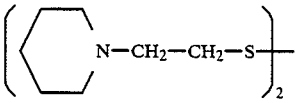
(II)-(8)

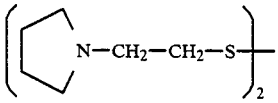
(II)-(9)

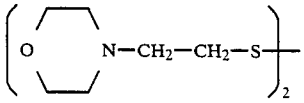
(II)-(10)

-continued
(III)-(1)
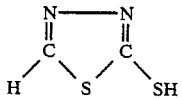
(III)-(2)
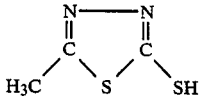
(III)-(3)
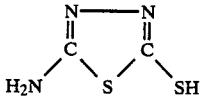
(III)-(4)
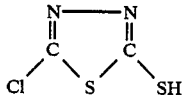
(IV)-(1)
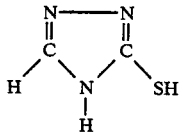
(IV)-(2)
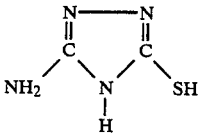
(IV)-(3)
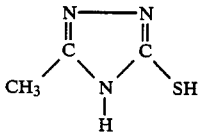
(V)-(1)
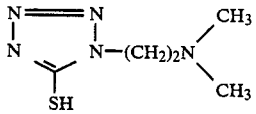
(V)-(2)
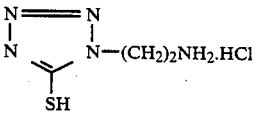
(VI)-(1)
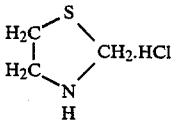
(VI)-(2)
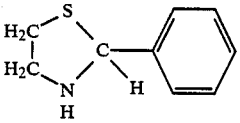
(VI)-(3)
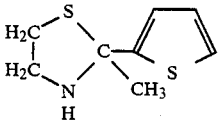
-continued
(VI)-(4)
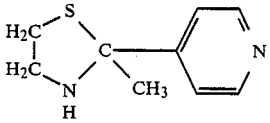
(VI)-(5)
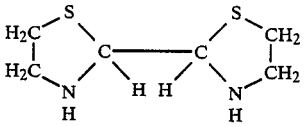
(VI)-(6)
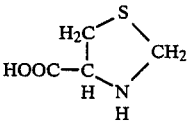
(VII)-(1)
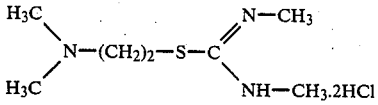
(VII)-(2)
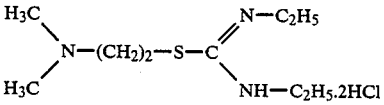
(VII)-(3)
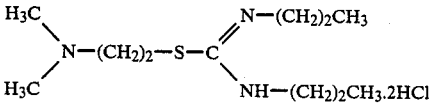
(VII)-(4)
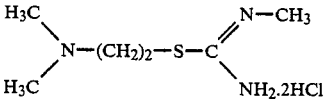
(VII)-(5)
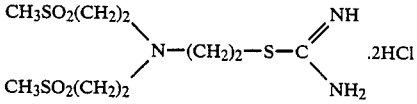
(VII)-(6)
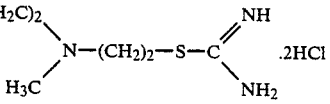
(VII)-(7)
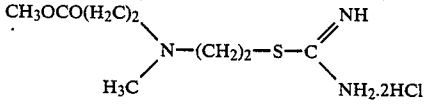
(VII)-(8)
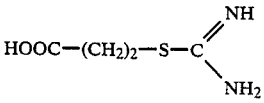
(VII)-(9)
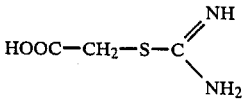
(VII)-(10)
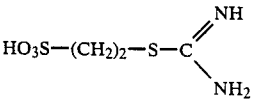

-continued

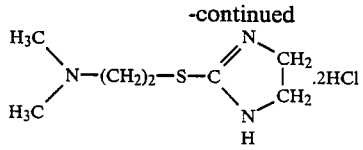

(VII)-(11)

The above-described compounds can be prepared by a known process. In particular, the processes for the production of the compounds are described in U.S. Pat. No. 4,285,984, G. Schwarzenbach et al., Helv. Chim. Acta., 38, 1147 (1955) and R. O. Clinton et al., J. Am. Chem. Soc., 70, 950 (1948) (for those of the general formula (I)), Japanese Patent Public Disclosure No. 53-95630 (for those of the general formula (II)), Japanese Patent Public Disclosure No. 54-52534 (for those of the general formulae (III) and (IV)), Japanese Patent Public Disclosure Nos. 51-68568, 51-70763 and 53-50169 (for those of the general formula (V)), Japanese Patent Publication No. 53-9854 and Japanese Patent Public Disclosure No. 59-214855 (for those of the general formula (VI)), and Japanese Patent Public Disclosure No. 53-94927 (for those of the general formula (VII)).

The amount of the compound having a mercapto group or disulfido bond in the molecule, a thiazoline derivative, or an isothiourea derivative, which are to be incorporated in the bleaching solution usable in the present invention, varies depending on the kind of the photographic material to be processed, processing temperature, and processing time. It is usually $1\times10^{-5}$ to $10^{-1}$ mol, preferably $1\times10^{-4}$ to $5\times10^{-2}$ mol per liter of the processing solution.

The compound of the present invention is usually added to the processing solution after dissolution thereof in water, an alkaline, an organic acid or an organic solvent. The compound in the form of a power can be directly added to the bleaching bath and, in such a case, no influence is exerted on the bleach accelerating effect.

The previously unfogged internal latent image-type (herein referred to as "internal latent image-type") silver halide emulsion, usable in the present invention is an emulsion of silver halide grains the surface of which has not previously been fogged and in which the latent image is formed mainly inside the grains. Preferably, when a given amount of the silver halide emulsion is applied to a transparent support and exposed to light for a given time in the range of 0.01 to 10 sec. and the development is conducted in the following developer A (internal developer) at 18° C. for 5 min., the maximum photographic density as determined by an ordinary photographic density determination method is at least five times, more preferably at least 10 times, as high as the maximum density provided when the same amount of the silver halide emulsion is applied to the support and exposed and the development is conducted with the following developer B (surface type developer) at 20° C. for 6 min.:

| Internal developer A | |
|---|---|
| Metol | 2 g |
| anhydrous sodium sulfite | 90 g |
| hydroquinone | 8 g |
| sodium carbonate monohydrate | 52.5 g |
| KBr | 5 g |
| KI | 0.5 g |
| water | ad 1 l |

-continued

| Surface developer B | |
|---|---|
| Metol | 2.5 g |
| l-ascorbic acid | 10 g |
| $NaBO_2 \cdot 4H_2O$ | 35 g |
| KBr | 1 g |
| water | ad 1 l |

Examples of the internal latent-image type emulsions include conversion-type silver halide emulsions and core/shell-type silver halide emulsions as described in British Patent No. 1011062 and U.S. Pat. Nos. 2,592,250 and 2,456,943. Examples of the core/shell-type silver halide emulsions include those described in Japenese Patent Public Disclosure Nos. 47-32813, 47-32814, 52-134721, 52-156614, 53-60222, 53-66218, 53-66727, 55-127549, 57-136641, 58-70221, 59-208540, 59-216136, 60-107641, 60-247237, 61-2148 and 61-3137, Japanese Patent Publication Nos. 56-18939, 58-1412, 58-1415, 58-6935 and 58-108528, Japanese patent application No. 61-36424, U.S. Pat. Nos. 3206313, 3317322, 3761266, 3761276, 3850637, 3923513, 4035185, 4395478 and 4504570, European Pat. No. 0017148, and Research Disclosure, No. RD 16345 (Nov., 1977).

Typical silver halides are silver chloride, silver bromide, and mixed silver halides such as silver chlorobromide, silver chloroiodobromide and silver iodobromide. The silver halides preferably used in the present invention are those which are free of silver iodide. They may be those containing less than 3 molar % of silver iodide, such as silver chloro(iodo)bromide, silver (iodo)chloride and silver (iodo)bromide.

The average size of the silver halide grains (the diameter of the grains when they are spherical or nearly spherical, or the edge length when they are cubic; the average size being determined from the diameter and edge length based on the projection areas of the grains) is preferably 0.1 to 2 μ, particularly preferably 0.15 to 1 μ. The grain size distribution range may be either narrow or wide. However, it is preferred to use so-called "monodisperse" silver halide emulsion having such a narrow grain size distribution that at least 90%, particularly at least 95% (in terms of the number of the grains or the weight), of the total grains have a diameter within the average grain diameter ±40% (more preferably ±30%, and most preferably, ±20%) so as to improve the graininess and sharpness in the present invention. To satisfy an intended gradation of the photosensitive material, two or more monodisperse silver halide emulsions different from each other in grain size can be used for forming emulsion layers having substantially the same color sensitivity, or grains having the same size but different sensitivities can be contained in the same layer or in different layers of a multiplelayer. Further, two or more polydisperse silver halide emulsions or a combination of a monodisperse emulsion with a polydisperse emulsion can be used in the form of a mixture of a multilayer.

The silver halide grains usable in the present invention may be in a regular form such as cubic, octahedral, dodecahedral or tetradecahedral form; an irregular crystal form such as spherical form; or a complex thereof. Further, the grains may be tabular ones. Particulary preferred is an emulsion in which at least 50%, based on the total projection area of the grains, of the grains have a ratio of a length to a thickness being at least 5, particularly at least 8. The emulsion may also comprise a mixture of grains having various crystalline forms.

The insides or surfaces of the silver halide grains in the emulsion usable in the present invention can be chemically sensitized by sulfur sensitization, selenium sensitization, reduction sensitization, or noble metal sensitization method, or by a combination of them.

The photographic emulsion to be used in the present invention is spectrally sensitized with a photographic sensitizing dye by an ordinary method. Particularly useful dyes are cyanin dyes, merocyanine dyes, and composite merocyanine dyes. They can be used either singly or as a combination of them. These dyes can be used in combination with a supersensitizer. Examples of them and methods of using them are described in, for example, RD 17643 (Dec., 1978) IV.

Additives can be incorporated in the present photographic emulsion for the purposes of preventing the fogging in the course of the production, storage or photographic processing of the photosensitive material, or accelerating the development or stabilizing the photographic properties. The additives include known antifoggants or stabilizers such as azoles, mercapto compounds, thiocarbonyl compounds, azaindenes (e.g. tetrazaindenes, preferaby 4-hydroxy-6-methyl-(1,3,3a,7) tetrazaindene), benzenethiosulfonic acids, benzenesulfinic acids, benzenesulfonic acid amides, purines (e.g. adenine), triazines, and phthalazinones.

More particularly, the azoles include, for example, triazoles, imidazoles, indazoles, and thiadiazoles. The mercapto compounds include, for example, mercaptotetrazoles, e.g. 1-phenyl-5-mercaptotetrazoles as shown below. More detailed examples of the antifoggants, stabilizers and methods of using them are described in, for example, U.S. Pat. Nos. 3,954,474 and 3,982,947, Japanese Patent Publication No. 52-28660, RD 17643 (Dec., 1978) VIA to VIM and E. J. Birr "Stabilization of Photographic Silver Halide Emulsions" (Focal Press, 1974).

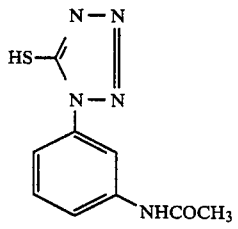

A nucleating agent can be added to the present photosensitive material or the processing solution therefor.

In case the nucleating agent is added to the photosensitive material, it is preferred to add the agent to the internal latent image-type silver halide emulsion layer. However, the nucleating agent can also be added to another layer such as an intermediate layer, substratum layer or back layer so far as the nucleating agent is diffused and adsorbed on the silver halide grains in the course of the application or processing. In case the nucleating agent is added to the processing solution, it may be incorporated in the developer, or a pre-processing bath having a low pH value as described in Japanese Patent Public Disclosure No. 58-178350.

As stated above, the nucleating agent to be used in the present invention can be contained in the photosensitive material or the processing solution for the photosensitive material. However, former is preferred to the latter.

The present overall exposure, i.e. fog exposure, is conducted after imagewise exposure but before the development and/or during development. After the imagewise exposure, the photosensitive material is immersed in a developer or preprocessing bath, and then exposed therein. Alternatively, the photosensitive material is exposed after taking it out from the developer or the pre-bath but before it is dried. It is most preferably to conduct the exposure in the developer.

As a light source for the fog exposure, those having a wave length within the sensitive range of the material can be used. Usually, any light sources such as luminescent lamps, tungsten lamps, xenon lamps, sunlight, etc. can be employed. When a photosensitive material sensitive to light of the overall wave length region such as color photosensitive material is used, a light source having a high color rendition (preferably high whiteness) as described in Japanese Patent Public Disclosure Nos. 59-137350 and 58-70223 is preferred. The luminance of the light is 0.01 to 2,000 lux, preferably 0.05 to 30 lux, and more preferably 0.05 to 5 lux. When the photosensitive material is composed of a high-speed emulsion, low luminance exposure is prferred. The luminance can be controlled by changing the luminous intensity of the light source, by reducing the luminance with a filter, by changing the distance between the photosensitive material and the light source, or by changing the angle formed by the photosensitive material and the light source. The exposure time can be reduced by using weak light in the initial stage of the exposure and then stronger light.

It is preferable that after the photosensitive material is immersed in a developer or pre-processing bath and then the solution has sufficiently penetrated into the emulsion layer of the photosensitive material, the light irradiation is conducted. The time required after the immersion and before the fog exposure is usually 2 sec. to 2 min., preferably 5 sec. to 1 min., and more preferably 10 to 30 sec.

The exposure time for the fogging is usually 0.01 sec. to 2 min., preferably 0.1 sec. to 1 min., and more preferably 1 to 40 sec.

In case the nucleating agent is contained in the photosensitive material, the amount of the agent is preferably $10^{-5}$ to $10^{-1}$ mol, and more preferably $10^{-4}$ to $10^{-2}$ mol, per mol of the silver halide.

In case the nucleating agent is added to the processing solution, the amount of the agent is preferably $10^{-8}$ to $10^{-3}$ mol, and more preferably $10^{-7}$ to $10^{-4}$ mol, per liter of the solution.

The nucleating agents usable in the present invention are preferably compounds of the following general formulae (N-I) and (N-II):

General formula (N-I):

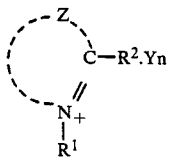

wherein Z represents a non-metallic atomic group necessary for forming a 5-membered or 6-membered heterocyclic ring, Z being unsubstituted or substituted with a substituent, $R^1$ represents an aliphatic group, $R^2$ represents a hydrogen atom or an aliphatic or aromatic group, $R^1$ and $R^2$ being unsubstituted or substituted with a substituent, with the proviso that at least one of $R^1$, $R^2$ and Z has an alkynyl group, acyl group, hydrazine group or hydrazone group, or $R^1$ and $R^2$ together form a 6-membered ring to form a dihydropyridinium nucleas, and at least one of the substituents of $R^1$, $R^2$ and Z may have $X^1$-$(L^1)_m$, $X^1$ being a group which accelerates the adsorption on the silver halide grains and $L^1$ being a divalent connecting group, Y represents a counter ion for balancing the electric charges, n represents 0 or 1 and m represents 0 or 1.

More particularly, the heterocyclic ring containing Z as a constituent include, for example, quinolinium, benzothiazolium, benzimidazolium, pyridinium, thiazolinium, thiazolium, naphthothiazolium, selenazolium, benzoselenzolium, imidazolium, tetrazolium, indolenium, pyrrolinium, acridinium, phenanthridinium, isoquinolinium, oxazolium, naphthoxazolium and benzoxazolium rings.

Examples of the substituents of Z include alkyl, alkenyl, aralkyl, aryl, alkynyl, hydroxyl, alkoxy and aryloxy groups, halogen atoms, amino, alkylthio, arylthio, acyloxy, acylamino, sulfonyl, sulfonyloxy, sulfonylamino, carboxyl, acyl, carbamoyl, sulfamoyl, sulfo, cyano, ureido, urethane, carbonic ester, hydrazine, hydrazone and imino groups. A substituent of Z is selected from, for example, the above-mentioned substituents. When two or more substituents are selected, they may be the same or different. Further, these substituents can further be substituted with the above-mentioned substituents.

In addition, the substituent of Z may be a quaternary ammonium group which forms a heterocyclic ring together with Z through a suitable connecting group L. In such a case, the product has a dimer structure.

Among the heterocyclic rings containing Z as a constituent, preferred are quinolinium, benzothiazolium, benzimidazolium, pyridinium, acridinium, phenanthridinium and isoquinolinium. Particularly preferred are quinolinium, benzothiazolium and benzimidazolium and more preferred are quinolinium and benzothiazolium. The most preferred is quinolinium.

The aliphatic groups $R^1$ and $R^2$ are unsubstituted alkyl groups having 1 to 18 carbon atoms or substituted alkyl groups having 1 to 18 carbon group in the alkyl moiety. The substituents of them are the same as those mentioned above as the substituents of Z.

The aromatic group as $R^2$ has 6 to 20 carbon atoms and it is, for example, phenyl or naphthyl group. The substituents of $R^2$ include those mentioned above as the substituents of Z.

At least one of the groups $R^1$, $R^2$ and Z has an alkynyl, acyl, hydrazine or hydrazone group, $R^1$ and $R^2$ are combined to form a 6-membered ring so as to form the dihydropyridinium nucleus. They may be substituted with a substituent described above as a substituent of Z. The hydrazine group has preferably an acyl or sulfonyl gruop as a substituent.

The hydrazone group has preferably an aliphatic or aromatic group as a substituent.

The acyl group is preferably formly group or an aliphatic or aromatic ketone.

Now, the alkynyl substituent of $R^1$, $R^2$ or Z will be further explained in detail although it has been partially explained above. The alkynyl substituents are preferably those having 2 to 18 carbon atoms, such as ethynyl, propargyl, 2-butynyl, 1-methylpropargyl, 1,1-dimethylpropargyl, 3-butynyl and 4-pentynyl groups.

They may be further substituted with the above-mentioned substituents of Z, such as 3-phenylpropargyl, 3-methoxycarbonylpropargyl and 4-methoxy-2-butynyl groups.

It is preferred that at least one of the substituents for the group represented by $R^1$, $R^2$ and Z is an alkynyl or acyl group, or that $R^1$ and $R^2$ are combined to form a dihydropyridinium nucleus. It is most preferred that at least one alkynyl group is contained as a substituent for the group represented by $R^1$, $R^2$ and Z.

Preferred examples of the group $X^1$ for accelerating the adsorption on the silver halide include thioamido group, mecapto group, and nitrogen-containing 5- or 6-membered heterocyclic groups.

The thioamido group represented by $X^1$ which accelerates the adsorption is a divalent group of the formula:

$$-\overset{\overset{\displaystyle S}{\|}}{C}\text{-amino-}$$

which may be a constituent of the ring or an acyclic thioamido group. The useful adsorption-accelerating thioamido group can be selected from those described in, for example, U.S. Pat. Nos. 4,030,925, 4,031,127, 4,080,207, 4,245,037, 4,255,511, 4,266,013 and 4,276,364, and Research Disclosure, Vol. 151, No. 15162 (Nov., 1976) and Vol. 176, No. 17626 (Dec., 1978).

Examples of the acyclic thioamido groups include thioureido, thiourethane and dithiocarbamic ester groups. Examples of the cyclic thioamido groups include groups of 4-thiazolin-2-thione, 4-imidazolin-2-thione, 2-thiohydantoin, rhodanine, thiobarbituric acid, tetrazolin-5-thione, 1,2,4-triazolin-3-thione, 1,3,4-thiadiazolin-2-thione, 1,3,4-oxadiazolin-2-thione, benzimidazolin-2-thione, benzoxazolin-2-thione and benzothiazolin-2-thione. They can be further substituted with a suitable substituent.

The mercapto group as $X^1$ is either —SH group directly bonded to the group represented by $R^1$, $R^2$ or Z, or —SH group bonded to a substituent of $R^1$, $R^2$ or Z. The mercapto groups include aliphatic mercapto groups, aromatic mercapto groups and heterocyclic mercapto groups (when a carbon atom bonded to the —SH group is adjacent to a nitrogen atom, the group is the same as a cyclic thioamido group which is tautomeric thereto; their examples being the same as the above-mentioned ones.

Examples of the nitrogen-containing 5- or 6-membered heterocyclic groups represented by $X^1$ include those composed of a combination of nitrogen, oxygen, sulfur and carbon atoms. Among them, preferred are benzotriazole, thiazole, tetrazole, indazole, benzimidazole, imidazole, benzothiazole, thiazole, benzoxazole, oxazole, thiadiazole, oxadiazole and triazine. They may be further substituted with a suitable substituent. The substituents may be those mentioned above as the substituents of Z. The nitrogen-containing heterocyclic compounds are more preferably benzotriazole, triazole, tetrazole and indazole, and most preferably benzotriazole.

The divalent connecting groups represented by $L^1$ include an atom or atomic groups comprising at least one of C, N, S and O. Examples of them are alkylene groups, alkenylene groups, alkynylene groups, arylene groups, —O—, —S—, —NH—, —N=, —CO— and —$SO_2$—. They may have a substituent and they can be used either singly or as a combination of them.

The counter ion Y for balancing the electric charge can be any anion capable of compensating a positive charge due to a quaternary ammonium salt in the heterocyclic ring. It is, for example, bromine ion, chlorine ion, iodine ion, p-toluenesulfonic acid ion, ethylsulfonic acid ion, perchloric acid ion, trifluoromethanesulfonic acid ion, and thiocyan ion. In such a case, n is 1. In case the heterocyclic quaternary ammonium salt contains an anionic substituent such as a sulfoalkyl substituent, the salt may be in betaine form. In this case, no counter ion is necessitated, and n is 0. In case the heterocyclic quaternary ammonium salt has two anionic substituents such as two sulfoalkyl groups, Y is a cationic counter ion, such as an alkali metal ion (e.g. sodium or potassium ion) or an ammonium ion (e.g. triethylammonium ion).

Examples of the compounds represented by the general formula (N-I) are shown below, which by no means limit the compounds of the present invention.

(1)

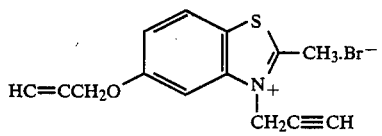

(2)

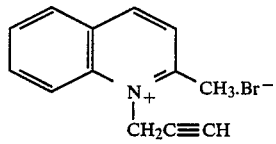

(3)

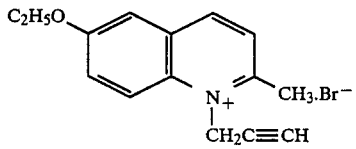

(4)

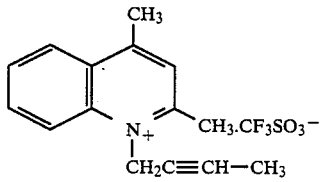

(5)

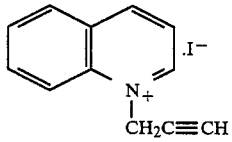

(6)

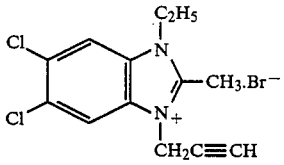

(7)

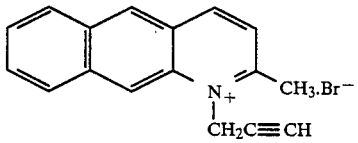

(8)

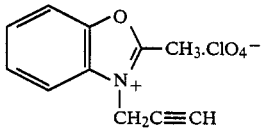

-continued
(9)
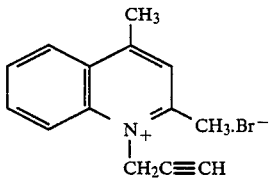
(10)
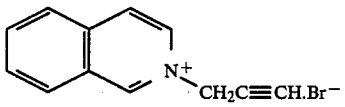
(11)
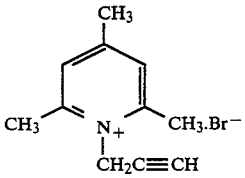
(12)
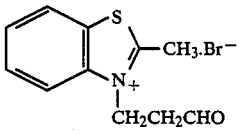
(13)
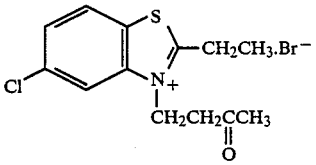
(14)
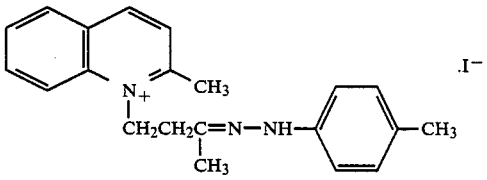
(15)
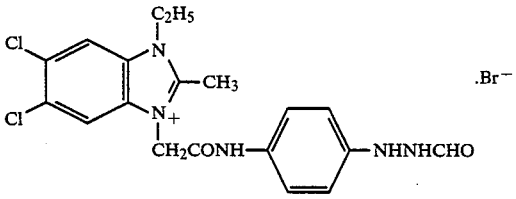
(16)
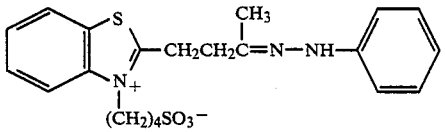
(17)
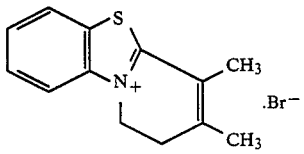

-continued
(18)
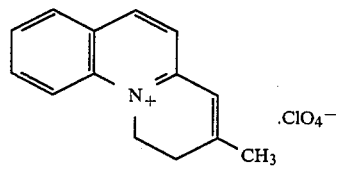
(19)
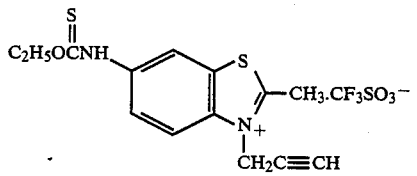
(20)
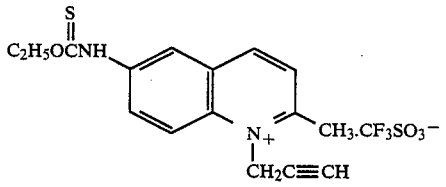
(21)
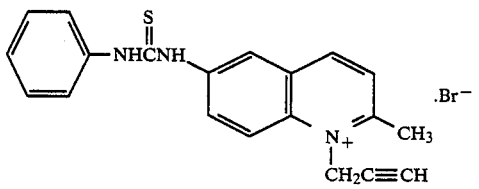
(22)
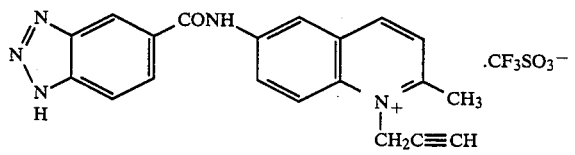
(23)
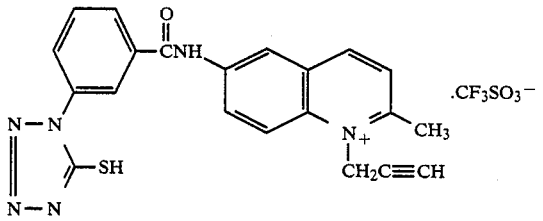
(24)
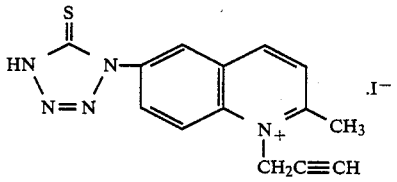
(25)
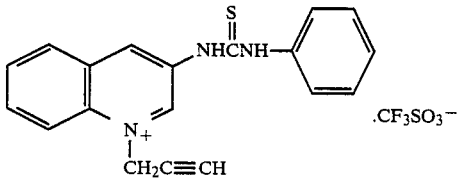

-continued
(26)
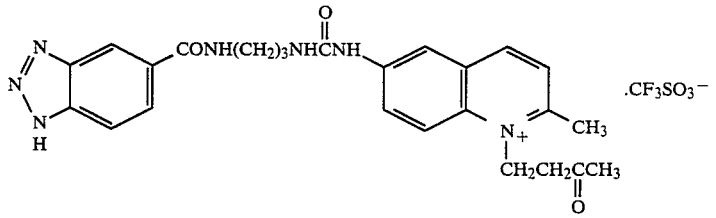
(27)
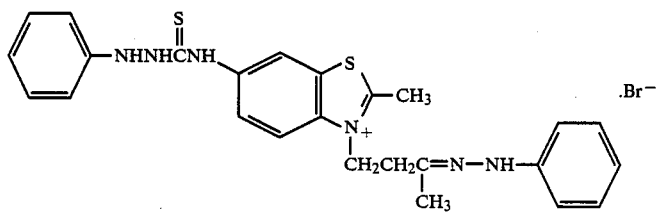
(28)
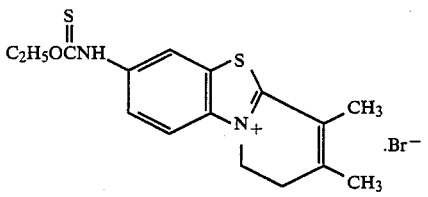
(29)
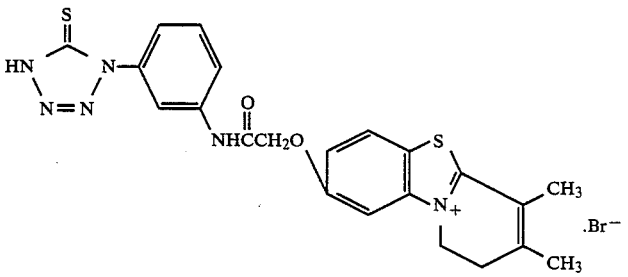
(30)
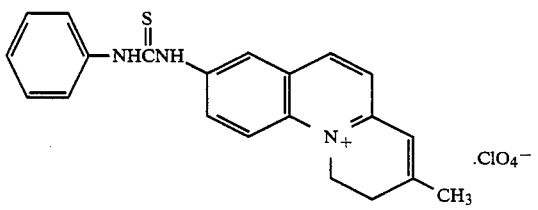
(31)
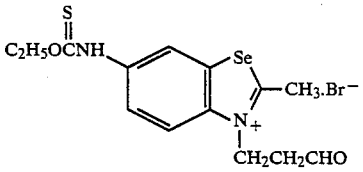
(32)
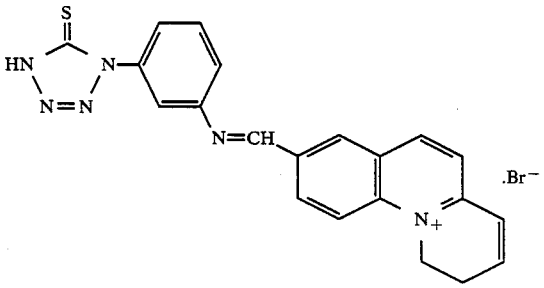

-continued (33)

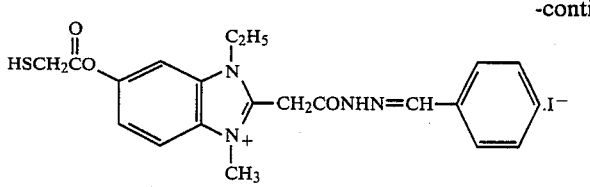

(34)

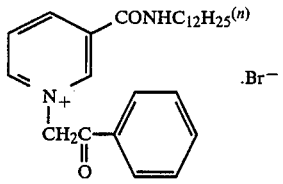

(35)

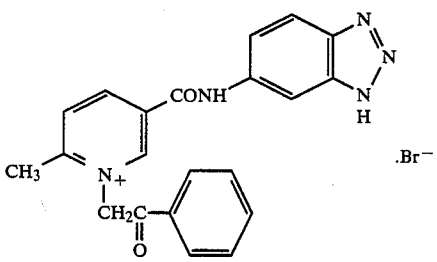

The above-mentioned compounds can be prepared by, for example, processes described in patents referred to in Research Disclosure, No. 22,534 (published in Jan., 1983), pages 50 to 54 and U.S. Pat. No. 4,471,044, or similar processes.

Genreal formula (N-II):

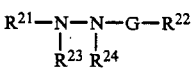

wherein $R^{21}$ represents an aliphatic, aromatic or heterocyclic group, $R^{22}$ represents a hydrogen atom or an alkyl, aralkyl, aryl, alkoxy, aryloxy, or amino group, G represents a carbonyl, sulfonyl sulfoxy, phosphoryl, or iminomethylene (HN=C<) group, and both $R^{23}$ and $R^{24}$ are hydrogen or one of them represents hydrogen and the other represents an alkylsulfonyl, arylsulfonyl or acyl group, with the proviso that G, $R^{23}$, $R^{24}$ and the hydrazine nitrogen may form together a hydrazone structure (>N—N=C<), and these groups may be substituted with a substituent, if possible.

The alipahtic group $R^{21}$ in the above general formula (N-II) is a straight chain, branched or cyclic alkyl group, alkenyl group or alkynyl group.

Examples of the aromatic groups represented by $R^{21}$ include monocyclic or bicyclic aryl groups such as phenyl and naphthyl groups.

The heterocyclic rings represented by $R^{21}$ are 3- to 10-membered, saturated or unsuturated heterocyclic rings containing at least one of N, O and S atoms. They may be monocyclic rings or they form condensed rings together with another aromatic ring or heterocyclic ring. Preferred heterocyclic rings are 5- or 6-membered aromatic heterocyclic groups, such as pyridyl, quinolinyl, imidazolyl and benzimidazolyl groups.

$R^{21}$ may be substituted with a substituent. Examples of the substituents are as shown below and they may be further substituted: alkyl, aralkyl, alkoxy, aryl, substituted amino, acylamino, sulfonylamino, ureido, urethane, aryloxy, sulfamoyl, carbamoyl, alkylthio, arylthio, sulfonyl, sulfinyl, hydroxy, cyano, sulfo and carboxyl groups and halogen atoms.

These groups can be connected to each other, if possible, to form a ring.

Preferred groups as $R^{21}$ are aromatic, aromatic heterocyclic and arylmethyl groups. More preferred are aryl groups.

When G is a carbonyl group, $R^{22}$ is preferably a hydrogen atom, an alkyl group (such as methyl, trifluoromethyl, 3-hydroxypropyl or 3-methanesulfonaminopropyl group), an aralkyl group (such as o-hydroxybenzyl group) or an aryl group (such as phenyl, 3,5-dichlorophenyl, o-methanesulfonamidophenyl or 4-methanesulfonylphenyl group). Among them, hydrogen atom is particularly preferred.

When G is a sulfonyl group, $R^{22}$ is preferably an alkyl group (such as methyl group), an aralkyl group (such as o-hydroxyphenylmethyl group), an aryl group (such as phenyl group) or a substituted amino group (such as dimethylamino group).

The substituents of $R^{22}$ are those mentioned above as the substituents of $R^{21}$ and, in addition, acyl, acyloxy, alkyl- or aryloxycarbonyl, alkenyl, alkynyl and nitro groups, etc.

These substituents may be further substituted with the substituents. If possible, they may be combined to form a ring.

It is preferrd that $R^{21}$ and $R^{22}$ (particularly $R^{21}$) have a nondiffusible group (such as coupler group) or, in other words, so-called ballast group. The ballast group has 8 or more carbon atoms and it is selected from the group consisting of alkyl, phenyl, ether, amido, ureido, urethane, sulfonamido and thioether groups. The ballast groups may be either alone or a combination of two or more of them.

$R^{21}$ or $R^{22}$ may contain a group of the general formula: $X^2$-(-$L^2$)$\overline{m}$2 which accelerates the adsorption of the compound of the general formula (N-II) on the silver halide grains. In this general formula, $X^2$ has the same meaning as $X^1$ in the above general formula (N-I)

and it is preferably a thioamido group (excluding thiosemicarbazido or substituted thiosemicarbazido group), mercapto group or a 5- or 6-membered nitrogen-containing heterocyclic group, $L^2$ represents a divalent connecting group which is the same as $L^1$ in the general formula (N-I), and $m^2$ represents 0 or 1.

More preferably, $X^2$ represents a cyclic thioamido group (i.e. a mercapto-substituted nitrogen-containing heterocyclic group such as 2-mercaptothiadiazole, 3-mercapto-1,2,4-triazole, 5-mercaptotetrazole, 2-mercapto-1,3,4-oxadiazole or 2-mercaptobenzoxazole group) or a nitrogen-containing heterocyclic group (such as benzotriazole, benzimidazole or indazole group).

Most preferably, $R^{23}$ and $R^{24}$ each represents a hydrogen atom. As G in the general formula (N-II), carbonyl group is most preferred.

It is preferred that the compounds of the general formula (N-II) contain a group which adsorbs on the silver halide grains. Particularly preferred groups which adsorb on the slver halide grains are mercapto, cyclic thioamido, ureido and nitrogen-containing heterocyclic groups as described above with reference to the general formula (N-I).

Examples of the compounds represented by the general formula (N-II) are shown below, which by no means limit the compounds of the present invention:

(36)

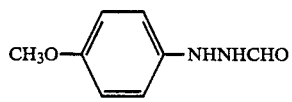

(37)

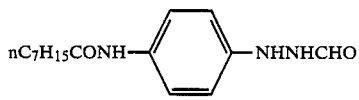

(38)

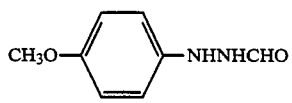

(39)

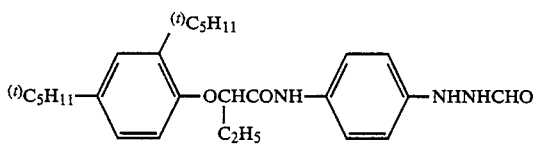

(40)

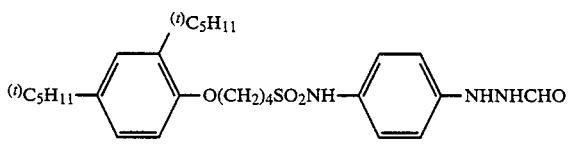

(41)

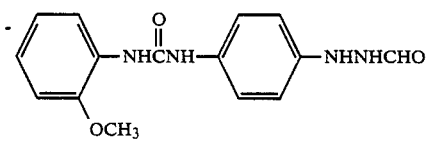

(42)

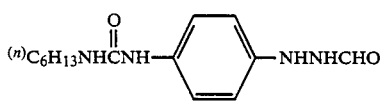

(43)

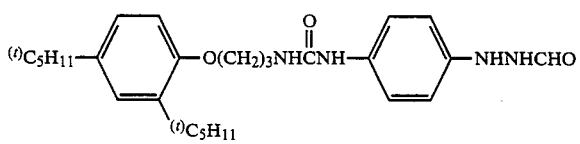

(44)

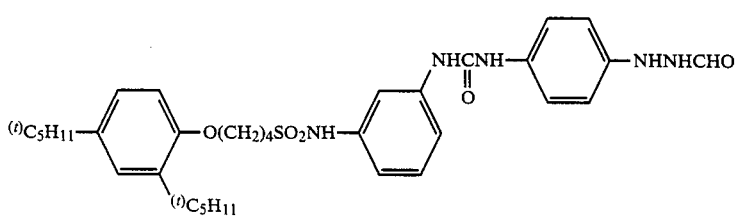

-continued
(45)
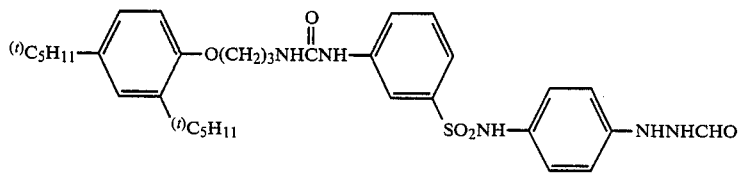
(46)
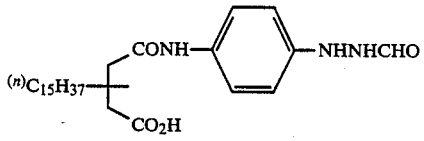
(47)
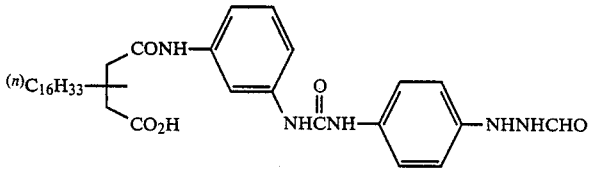
(48)
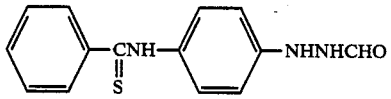
(49)
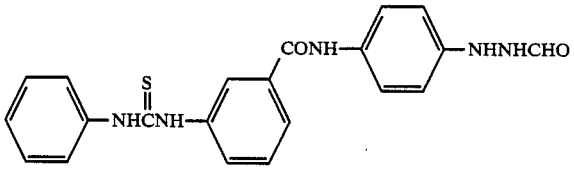
(50)
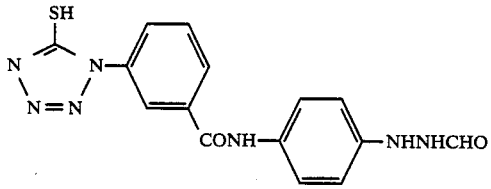
(51)
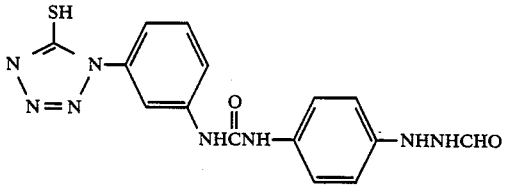
(52)
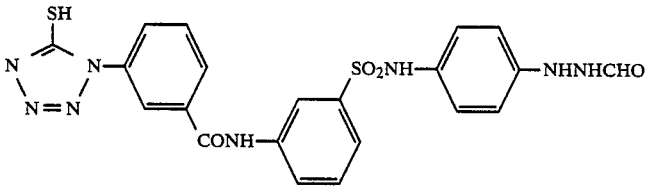
(53)
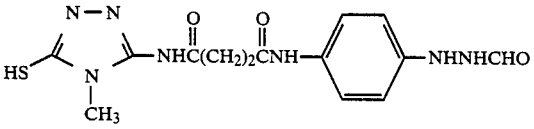

-continued
(54)
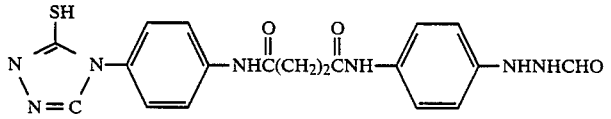
(55)
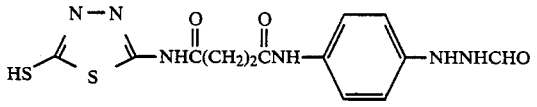
(56)
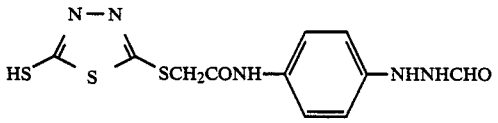
(57)
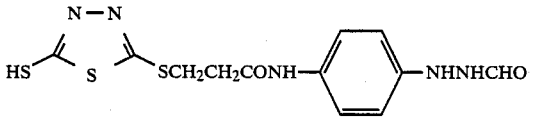
(58)
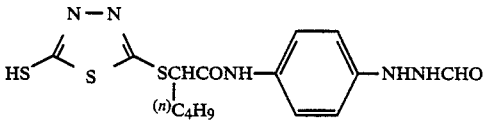
(59)
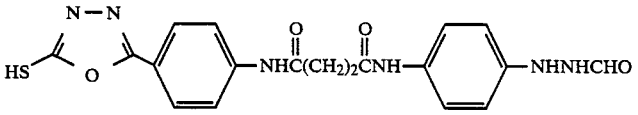
(60)
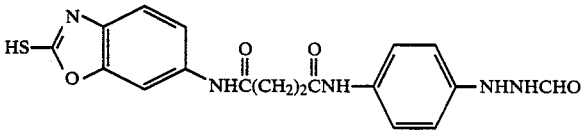
(61)
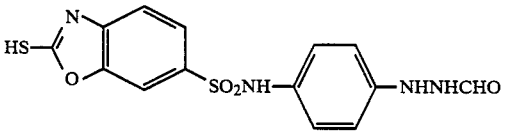
(62)
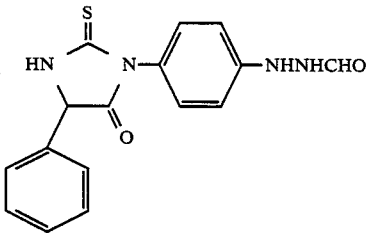
(63)
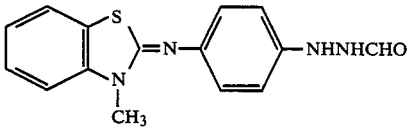
(64)
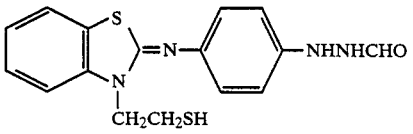

-continued
(65)
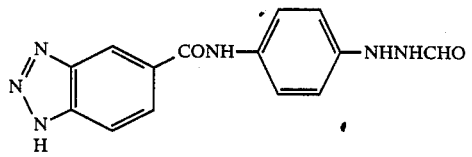
(66)
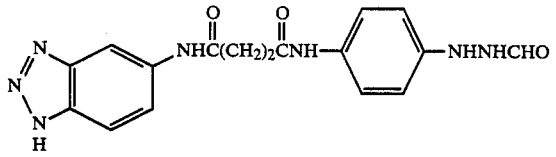
(67)
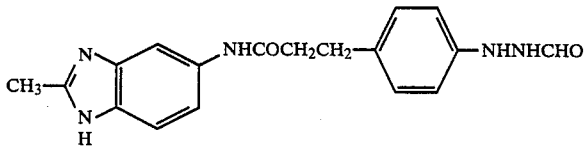
(68)
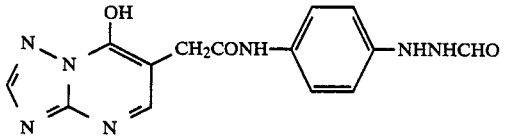
(69)
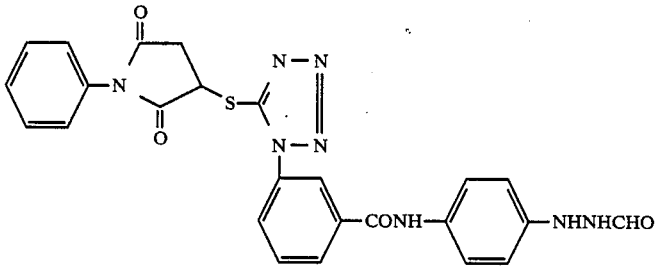
(70)
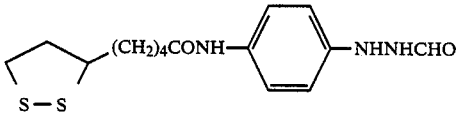
(71)
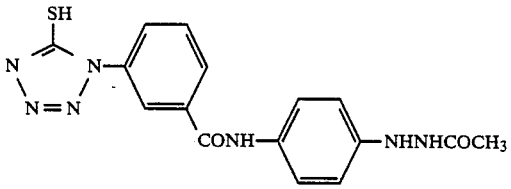
(72)
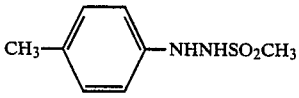
(73)
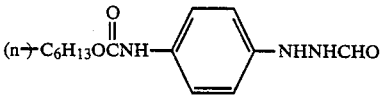
(74)
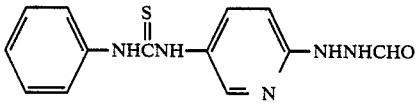

-continued $(n)\text{-}C_{12}H_{25}NHNHCHO$ (75)

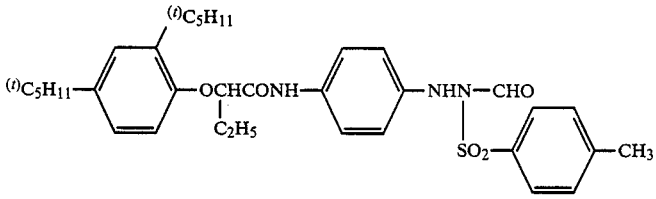
(76)

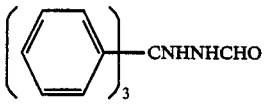
(77)

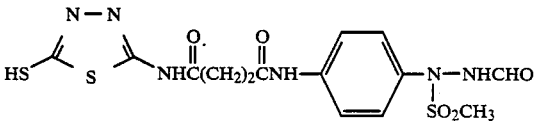
(78)

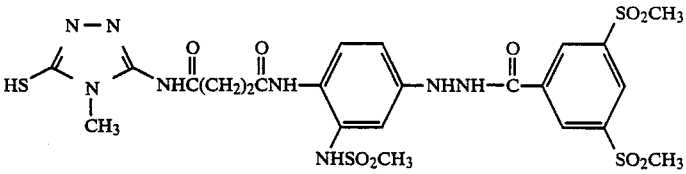
(79)

Processes for preparing the compounds of the general formula (N-II) usable in the present invention are described in, for example, patents referred to in Research Disclosure, No. 15,162 (Nov., 1976), pages 76 to 77, No. 22,534 (Jan., 1983), pages 50 to 54 and No. 23,510 (Nov., 1983), pages 346 to 352, U.S. Pat. Nos. 4,080,207, 4,269,924, 4,276,364, 4,278,748, 4,385,108, 4,459,347, 4,478,928 and 4,560,638, British Pat. No. 2,011,391B and Japanese Patent Public Disclosure No. 60-179734.

The light fogging processes which can be employed in the present invention are described in, for example, British Pat. No. 1,151,363, Japanese Patent Publication Nos. 45-12710, 45-12709 and 58-6936 and Japanese Patent Public Disclosure No. 48-9727, 56-137350, 57-129438, 58-62652, 58-60739 and 58-70223 (corresponding to U.S. Pat. No. 4,440,851) and 58-120248 (corresponding to European Pat. No. 89101A2).

The following compounds can be used in combination with the nucleating agent for the purposes of increasing the maximum density, descreasing the minimum density and accelerating the nucleating development: hydroquinones (such as compounds described in U.S. Pat. Nos. 3,227,552 and 4,279,987); chromans, e.g. those described in U.S. Pat. No. 4,268,621, Japanese Patent Public Disclosure No. 54-103031 and Research Disclosure, No. 18264 (1979); tetrazaindenes, pyrazoles, triazoles and benzotriazoles (such as those described in U.S. Pat. No. 4,572,892); thiadiazoles; pyridazines; triazines; triazolotriazoles; diazaindenes; triazaindenes; pentazaindenes; phthalazinones; indazoles; benzimidazoles, benzothiazoles; benzoctazoles (such as those described in Japanese Pagent Public Disclosure Nos. 53-94211 and 60-170843); quinones, e.g. those described in Research Disclosure, No. 21206 (1981)); amines (such as those described in U.S. Pat. No. 4,150,993 and Japanese Patent Public Disclosure No. 58-174757); oxidizing agents, e.g. such as those described in Japanese Patent Public Disclosure No. 60-260039 and Research Disclosure, No. 16936 (1978); catechols (such as those described in Japanese Patent Public Disclosure Nos. 55-21013 and 55-65944); compounds which release a nucleating agent in the development step (such as those described in Japanese Patent Public Disclosure No. 60-107029); thioreas (such as those described in Japanese Patent Public Disclosure No. 60-95533); spirobisindances (such as those described in Japanese Patent Public Disclosure No. 55-65944); mercapto compounds (such as those described in U.S. Pat. No. 3,708,298 and Japanese Patent Public Disclosures No. 60-170843); and nitrogen-containing heterocyclic compounds described in Japanese Patent Public Disclosure No. 50-97091 and Research Disclosure, No. 15162 (1976).

Various color couplers can be used for forming a direct positive color image. The usable color couplers are those which per se are substantially non-diffusible and capable of forming or releasing a substantially non-diffusible and capable of forming or releasing a substantially non-diffusible dye upon coupling reaction with oxidized aromatic primary amine developer. Typical examples of the useful color couplers include naphthol compounds, phenol compounds, pyrazolone compounds, pyrazoloazole compounds and open chain or heterocyclic ketomethylene compounds. Examples of these cyan, magenta and yellow couplers are described in patents referred to in Research Disclosure, No. 17643 (published in Dec., 1978) VII-D and No. 18717 (published in Nov., 1979).

Typical examples of the yellow couplers usable in the present invention include divalent yellow couplers of oxygen-linked coupling-off type or nitrogen-linked coupling-off type. Particularly, α-pivaloylacetanilide couplers are preferred, since the provided color dye has an excellent fastness, particularly light fastness. α-Benzoylacetanilide couplers are also preferred, since they provide a high color density.

5-Pyrazolone magenta couplers preferably usable in the present invention are those having an arylamino substituent or acylamino substituent at position 3. Among them, divalent couplers of sulfur-linked coupling-off type are preferred.

More preferred are pyrazoloazole couplers such as prazolo(5,1-C)(1,2,4)triazoles described in U.S. Pat. No. 3,725,067. Imidazo(1,2-b)pyrazoles described in U.S. Pat. No. 4,500,630 are much more preferred because the developed dye has a low yellow sub-absorption and light fastness. Pyrazolo(1,5-b)(1,2,4)traizole described in U.S. Pat. No. 4,540,654 are particularly preferred.

The cyan couplers preferably usable in the present invention are naphthol and phenol couplers described in U.S. Pat. Nos. 2,474,293 and 4,052,212 and phenolic cyan couplers havng ethyl or higher alkyl group at meta-position of the phenol nucleus as described in U.S. Pat. No. 3,772,002. Further, 2,5-diacylamino-substituted phenol couplers are also preferred from the viewpoint of the color image fastness.

Other couplers usable in the present invention include colored couplers for compensating unnecessary absorption of the formed dye in a short wave length region; such couplers that the developed dye has a suitable diffusibility; colorless couplers; DIR couplers which release a development inhibitor in the course of the coupling reaction; couplers or polymerized couplers which release a development accelerator; etc.

The standard amount of the color couplers is in the range of 0.001 to 1 mol, preferably 0.01 to 0.5 mol for yellow couplers, 0.003 to 0.3 mol for magenta couplers or 0.002 to 0.3 mol for cyan couplers, per mol of the photosensitive silver halide.

The photosensitive material produced by the process of the present invention may contain, as a color antifoggant or color mixing inhibitor, a hydroquinone derivative, aminophenol derivative, amine, gallic acid derivative, catechol derivative, ascorbic acid derivative, colorless compound-forming coupler, or sulfonamidophenol derivative.

The photosensitive material of the present invention can contain various decoloration inhibitors. Typical examples of organic decoloration inhibitors include hydroquinones, 6-hydroxychromans, 5-hydroxycoumaranes, spirochromans, p-alkoxyphenols, hindered phenols such as bisphenols, gallic acid derivatives, methylenedioxybenzenes, aminophenols, hindered amines, and ether or ester derivatives prepared by silylating or alkylating the phenolic hydroxyl groups of these compounds. Further, metal complexes such as (bissalicylaldoximato)nickel complexes and (bis-N,N-dialkyldithiocarbamato)nickel complexes are also usable.

For preventing the deterioration of the yellow dye image due to heat, temperature and light, compounds having both hindered amine structure and hindered phenol structure in the molecule as described in U.S. Pat. No. 4,268,593 are effective. For the prevention of the deterioration, particularly, deterioration by light, of the magenta dye image, good results are obtained when spiroindanes described in Japanese Patent Public Disclosure No. 56-159644 or chromans substituted with a hydroquinone diether or monoether are used. The object can be attained by emulsify usually 5 to 100 wt. %, based on the corresponding color coupler, of these compounds together with the coupler and then incorporating them into the photosensitive layer. It is effective to introduce a U.V. absorber in both layers adjacent to the cyan coloring layer, for inhibiting the deterioration of the cyan dye image by heat and particularly by light. The U.V. absorber can be incorporated also in a hydrophilic colloid layers such as a protective layer.

As a binder or protective colloid which can be contained in the emulsion layer or intermediate layer of the present photosensitive material, gelatin is advantageously used and, in addition, other hydrophilic colloids can also be used.

The photosensitive material of the present invention can obtain a dye which inhibits irradiation or halation, a plasticizer, a fluorescent brightening agent, a matting agent, an aerial antifoggant, a coating aid, a hardener, an antistatic agent and a slide improver. Typical examples of these additives are described in Research Disclosure, No. 17643 (published in Dec., 1978) and No. 18716 (published in Nov., 1979).

The present invention can be employed also for the production of a multi-layered, multi-colored photographic material having at least two layers having different spectral sensitivities. Multi-layered color photographic materials comprise, on a support, at least one red-sensitive emulsion layer, at least one green-sensitive emulsion layer, and at least one blue-sensitive emulsion layer. The arrangement of the layers is optionally determined. A preferred arrangement of them is such that the structure comprises a red-sensitive layer, a green-sensitive layer, and a blue-sensitive layer in order from a support; or a blue-sensitive layer, red-sensitive layer and green-sensitive layer in order from a support. Each of the emulsion layers can comprise two or more emulsion layers having different sensitivities or, alternatively, a non-photosensitive layer can be placed between two or more emulsion layers having the same sensitivity. Usually, the red-sensitive emulsion layer contains a cyan-producing coupler, the green-sensitive emulsion layer contains a magenta-producing coupler, and the blue-sensitive emulsion layer contains a yellow-producing coupler. However, other combinations can be employed as occasion demands. The U.V. absorber can be incorporated also in a hydrophilic colloid layer such as a protective layer.

The photosensitive material of the present invention has preferably a suitable auxiliary layer such as a protective layer, intermediate layer, filter layer, antihalation layer and backng layer, as well as the silver halide emulsion layers.

The photosensitive emulsion layers and other layers of the present photosensitive material are formed by applying the emulsions to a flexible support usually used in photosensitive materials, such as a plastic film, paper or cloth, or a rigid support such as glass, porcelain or metal. The flexible supports usable in the present invention include, for example, films of semi-synthetic or synthetic high molecular materials such as cellulose nitrate, cellulose acetate, cellulose acetate butyrate, polystyrene, polyvinyl chloride, polyethylene terephthalate and polycarbonates; and papers having a baryta layer formed thereon or papers coated or laminated with α-olefin polymers (such as polyethylene, polypropylene and ethylene/butene copolymer). The supports may be colored with a dye or a pigment. The supports may be colored in black to shield the light. The surface of such a support is primed in order to facilitate the adhesion to the photographic emulsion layer. The surface of the support may be subjected to a glow discharge, corona discharge, U.V. irradiation or flame treatment, before or after the priming.

The silver halide photographic emulsion layers and other hydrophilic colloid layers can be formed by various coating methods such as dip coating method, roller coating method, curtain coating method, and extrusion coating method.

Various color photosensitive materials can be used in the present invention. Typical examples of them include reversal color films and reversal color papers for slides and televisions. The process of the present invention can be employed for producing color hard copies for maintaining images produced by a full-color copying machine or CRT. Further, black-and-white photosensitive materials containing a three-color coupler mixture as described in Research Disclosure, No. 17123 (publised in July, 1978) can be employed in the process of the present invention.

A color developer usable in the developing process of the photosensitive material of the present invention is a so-called surface developer substantially free of a solvent for the silver halide. It is preferably an alkaline aqueous solution containing an aromatic primary amine color developing agent as a main component. The term "substantially free of a solvent for the silver halide" herein indicates that the developer can contain a small amount of a solvent for the silver halide so far as the object of the present invention is not inhibited.

The color developing agents are aminophenol compounds, and particularly preferably p-phenylenediamine compounds. Typical examples thereof include 3-methyl-4-amino-N,N-diethylaniline, 3-methyl-4-amino-N-ethyl-N-$\beta$-hydroxylethylaniline, 3-methyl-4-amino-N-ethyl-N-$\beta$-methanesulfonamidoethylaniline, 3-methyl-4-amino-N-ethyl-N-$\beta$-methoxyethylaniline and their sulfates, hydrochlorides, phosphates, p-toluenesulfonates, tetraphenylborates and p-(t-octyl)benzenesulfonates. These diamines in the form of their salts are generally more stable than those in the free form. The amount of the color developing agent is preferably about 0.1 to 30 g, more preferably about 1 to 15 g, per liter of the color developer. The pH of the color developer is usually at least 7, more usually about 9 to 13, and preferably 11.5 or below. The replenisher of the color developer can be reduced in amount by controlling the concentrations of the halide and color developing agent contained therein.

The color developer can contain a special antifoggant and development restrainer, or these additives can be incorporated in a layer constituting the photosensitive material. Useful antifoggants usually include tetrazainindenes, benzimidazoles, benzotriazoles, benzothiazoles, benzoxazoles, 1-phenyl-5-mercaptotetrazole, heterocyclic thions such as thiadiazoles and aromatic and aliphatic mercapto compounds. Some of these additives have not only the antifogging effects, but also an effect of accelerating the development to increase the maximum image density ($D_{max}$).

The color development processing time required in the present invention is usually within 5 min. It is preferred, however, to complete the color development process within 2.5 min. for the purpose of accelerating it. More preferably, the color development process is completed within 30 sec. to 2 min. The shorter the time, the better, so far as a sufficient color density is provided.

From the viewpoint of inhibiting the environmental pollution, easiness of the preparation of the developer or improvement in the storage stability, it is preferred that the color developer is substantially free of benzyl alcohol. The term "substantially free of benzyl alcohol" means that the benzyl alcohol concentration in the color developer is less than 2 ml/l, preferably less than 0.5 ml/l, and most preferably it is free of benzyl alcohol.

A color developing agent or its precursor can be incorporated in the silver halide color photosensitive material of the present invention so as to facilitate or to accelerate the process. The precursor is preferable to the color developing agent, since the effect of the former to increase the stability of the photosensitive material is superior to that of the latter. Examples of the precursors of the developing agents include indoaniline compounds, Schiff bases, aldols and urethanes.

The silver halides color photosensitive material of the present invention can contain various 1-phenyl-3-pyrazolidones so as to accelerate the color development.

The color developer of the present invention can contain pH buffering agents, preservatives and metal chelate compounds as described in pages 14 to 22 of Japanese patent application No. 61-23462. Further, it can contain a halide ion such as bromide ion or iodide ion and a competing coupler such as citrazinic acid.

The photographic emulsion layers are usually bleached after the color development. The bleaching process can be conducted either simultaneously with the fixing process in a combined bleach-fixing bath or separately from the fixing process. Further, to accelerate the process, a bleach-fixing can be conducted after the bleaching or, alternatively, the bleach-fix can be conducted after the fixing.

The bleaching agetns usable in the bleaching process or bleach-fixing process are preferably organic complex salts and persulfates of iron (III) from the viewpoint of the rapid process and prevention of the environmental pollution.

Among the organic complex salts of iron (III), ferric ethylenediaminetetraacetate, diethylenetriaminepentaacetate, cyclohexanediaminetetraacetate, 1,2-diaminopropanetetraacetate, methyliminodiacetate, 1,3-diaminopropanetetraacetate and glycol ether diaminetetraacetate are preferred, since they have a high bleaching power.

Preferred persulfates are alkali metal persulfates such as potassium persulfate and sodium persulfate and ammonium persulfate.

The amount of the bleaching agent per liter of the bleaching solution is preferably 0.1 to 2 mol. The preferred pH range of the bleaching solution is 0.5 to 8.0 in case a ferric ion complex salt is used, or it is 4.0 to 7.0 in case a ferric ion complex salt of an aminopolycarboxylic acid, aminopolyphosphonic acid, phosphonocarboxylic acid or organic phosphonic acid is used. When 0.1 to 2 mol/l of a persulfate is used, the preferred pH range is 1 to 5.

The fixing agents usable in the bleach-fixing are known water-soluble solvents for the silver halides, for example, thiosulfates such as sodium thiosulfate and ammonium thiosulfate; thiocyanates such as sodium thiocyanate and ammonium thiocyanate; and thioethers, e.g. ethylenebisthioglycolic acid and 3,6-dithia-1,8-octanediol and thioureas. They can be used either singly or in the form of a mixture of two or more of them.

In the fixing or bleach-fixing process, the concentration of the fixing agent is desirably 0.2 to 4 mol/l. In the bleach-fixing process, the amounts of the ferric ion complex salt and fixing agent are 0.1 to 2 mol and 0.2 to 4 mol, respectively, per liter of the bleach-fixing solution. The pH of the fixing solution or the bleach-fixing solution is usually preferably 4.0 to 9.0 and particularly 5.0 to 8.0.

The fixing solution or bleach-fixing solution can contain, in addition to the above-mentioned additives capable of being contained in the bleaching solution, a preservative such as a sulfite (e.g. sodium sulfite, potassium sulfite or ammonium sulfite), a bisulfite, hydroxylamine, hydrazine or a bisulfite adduct of an aldehyde (e.g. acetaldehyde/sodium bisulfite). Further, the fixing solution or bleach-fixing solution can contain a fluorescent brightening agent, defoaming agent, surfactant and organic solvent such as polyvinylpyrrolidone or methanol.

The bleaching solution, bleach-fixing solution and pre-processing baths can contain, as well as the present bleaching accelerator, iodides, polyethylene oxides and polyamines, if necessary. They can further contain compounds described in Japanese Patent Public Disclosure Nos. 49-42434, 49-59644, 53-94927, 54-35727, 55-26506 and 58-163940 and iodine and bromine ions. Among them, the compounds having mercapto group or disulfido group are preferred, since they have a high accelerating effect. In particular, the compounds described in U.S. Pat. No. 3,893,858, West German Pat. No. 1,290,812 and Japanese Patent Public Disclosure No. 53-95630 are preferred. Further, the compounds described in U.S. Pat. No. 4,552,834 are also preferred. These bleaching accelerators may be incorporated into a photosensitive material.

Water washing, stabilization, etc. are conducted usually after the fixing step or bleach-fixing step.

In the water washing step and stabilization step, various known compounds can be used so as to inhibit the precipitation or to stabilize the washing water. These additives include chelating agents such as inorganic phosphoric acids, aminopolycarboxylic acids and organic phosphonic acids; germicides and antifungal agents for inhibiting the growth of bacteria, algae and fungi (such as those described in J. Antibact. Antifung. Agents, Vol. 11, No. 5, pages 207 to 223 (1983) and "Bokin Bokabi no Kagaku (Chemistry for Prevention of Bacteria and Fungi)"; metal salts such as magnesium, alminum and bismuth salts; alkali metals; ammonium salts; and surfactants for inhibiting drying load or drying mark, if necessary. Further, the compounds described in West, Phot. Sci. Eng., Vol. 6, pages 344 to 359 (1965) can be used as additives. Particularly, the chelating agents, germicides and antifungal agents are effective.

In the step of the water washing, usually two or more vessels (for example, 2 to 9 vessels) are used to provide a multistage countercurrent washing system so that the washing water is saved. A multistage countercurrent stabilization process as described in Japanese Patent Public Disclosure No. 57-8543 can be conducted in place of the water washing step. The stabilization bath contains, in addition to the above-mentioned additives, various compounds so as to stabilize the image. They include, for example, buffering agents for controlling the pH of the film at, for example, 3 to 9, (such as borates, metaborates, borax, phosphates, carbonates, potassium hydroxide, sodium hydroxide, aqueous ammonia, monocarboxylic acids, dicarboxylic acids and polycarboxylic acids which are used as a combination thereof) and aldehydes such as formalin. The stabilization bath can contain other additives such as chelating agents (e.g. inorganic phosphoric acids, aminopolycarboxylic acids, organic phosphonic acids, aminopolyphosphonic acids and phosphonocarboxylic acids); germicides and antifugal agents (e.g. thiazole compounds, isothiazole compounds, halogenated phenols, sulfanylamide and benzotriazole); surfactants; fluorescent brightening agents; hardeners; and metal salts. They can be used either singly or as a combination of two or more of them having the same or different effects.

It is preferred that for improving the image preservation, there are used ammonium salts such as ammonium chloride, ammonium nitrate, ammonium sulfate, ammonium phosphate, ammonium sulfite and ammonium thiosulfate as the pH-regulating agent for the film after the above-described steps.

The time required for the water washing and stabilization according to the present invention is usually 20 sec. to 10 min., preferably 20 sec. to 5 min., although it varies depending on the kind of the photosensitive material and the processing conditions.

The processing solutions are used at a temperature of 10° to 50° C. in the present invention. Although the standard temperature is 33° to 38° C., a higher temperature can be employed so as to accelerate the process or to reduce the processing time. On the other hand, a lower temperature can also be employed so as to improve the image quality and the stability of the processing solution.

The processing time can be made shorter than the standard one so as to complete the process rapidly so far as no trouble is caused by the time reduction.

When the processing is conducted continuously, the replenisher for each processing solution is used for inhibiting a change of the composition of the solution in order to obtain an intended finish.

If necessary, a heater, temperature sensor, liquid level sensor, circulation pump, filter, floating lid and squeegee can be placed in the respective processing baths.

EXAMPLES

The following examples will further illustrate the present invention.

Preparation of Internal Latent Image-Type Silver -Halide Emulsion (1) Emulsion A An aqueous solution of potassium bromide and an aqueous solution of silver nitrate were added simultaneously to an aqueous gelatin solution under vigorous stirring at 75° C. in about 40 min., to obtain a monodisperse silver bromide emulsion in which the grains were octahedral and had an average grain diameter of 0.4 μm. Sodium thiosulfate and chloroauric acid (tetrahydrate) each in an amount of 4 mg per mol of silver were added to the emulsion and the mixture was heated at 75° C. for 80 min. to conduct the chemical sensitization.

To the thus obtained silver bromide grains cores, an aqueous solution of 2 mol of sodium chloride and an aqueous solution of 1 mol of silver nitrate were added at 75° C. over 40 min. to grow the grains, so as to obtain an emulsion of core/shell-type cubic silver chlorobromide grains (0.6 μm). After water washing followed by desalting, sodium thiosulfate in an amount of 0.5 mg per mol of silver was added to the emulsion. The mixture was heated at 55° C. for 60 min. to conduct the chemical sensitization. Thus, Emulsion A of core/shell-type was obtained.

Emulsion B

An aqueous potassium bromide solution and an aqueous silver nitrate solution were added simultaneously to an aqueous gelatin solution containing potassium bromide under vigorous stirring at 75° C. over about 60 min., to obtain a silver bromide emulsion. 3,4-Dimethyl-1,3-thiazolin-2-thione and benzimidazole in amounts of 150 mg and 15 g, respectively, per mol of silver, were added to the aqueous gelatin solution as solvents for the silver halide before the precipitation (by simultaneous mixing). After completion of the precipitation, uniform octahedral silver bromide crystals having an average grain diameter of about 0.8 μm were formed. Sodium thiosulfate and potassium chloroaurate in amounts of 4.8 mg and 2.4 mg, respectively, per mol of silver, were added to the resultant silver bromide grains and the mixture was heated at 75° C. for 80 min., so as to conduct the chemical sensitization. Aqueous solutions of potassium bromide and silver nitrate were mixed with the thus chemically sensitized core emulsion over 45 min. in the same manner as above, to form an internal latent image-core/shell-type emulsion. 2.5 g/mol-Ag of hydrogen peroxide was added thereto as an oxidizing agent and the mixture was heated at 75° C. for 8 min. and then water-washed, to obtain an emulsion in which the grains had an average grain diameter of 1.0 μm.

Sodium thiosulfate and poly(N-vinylpyrrolidone) in amounts of 0.75 mg and 20 mg, respectively, per mol of silver, were added to the internal latent image-type core/shell emulsion and the mixture was heated at 60° C. for 60 min. to conduct the chemical sensitization (ripening). Thus, Emulsion B of core/shell-type was obtained.

Multi-layer color photo-sensitive materials having layer structures as shown in Table 1 were prepared on paper supports laminated with polyethylene on both sides, by using the core/shell-type direct positive emulsion A or B. The coating solutions were prepared as follows:

Preparation of Multi-Layer Color Photosensitive Materials Nos. (1) to (12) and Processes Therefor Preparation of the fifth coating solution: 10 ml of ethyl acetate and 4 ml of a solvent (m) were added to 10 g of a yellow coupler (k) and 2.3 g of a color image stabilizer (1), to prepare a solution. The solution was dispersed in 90 ml of 10% aqueous gelatin solution containing 5 ml of 10% sodium dodecylbenzenesulfonate, to prepare an emulsion dispersion. On the other hand, $2.0\times10^{-4}$ mol (per mol of silver) of a blue-sensitive dye shown below was added to the emulsion, to prepare 90 g of a blue-sensitive emulsion. The emulsion dispersion and the emulsion were mixed together to obtain a solution. The concentration of the solution was controlled with gelatin, so as to provide a composition shown in Table 1. A nucleating agent was added thereto to prepare a coating solution for forming the fifth layer.

Coating solutions for forming the first to the fourth layers and the sixth and seventh layers were prepared in the same manner as above (see Table 1). Sodium 1-hydroxy-3,5-dichloro-s-triazine was used as a hardener for the gelatin in each layer.

TABLE 1

| Layer | Main composition | Amount |
|---|---|---|
| The seventh layer (protective layer) | gelatin | 1.33 g/m$^2$ |
| | acryl-modified polyvinyl alcohol copolymer (degree of modification: 17%) | 0.17 g/m$^2$ |
| The sixth layer (U.V. absorbing layer) | gelatin | 0.54 |
| | U.V. absorber (h) | $5.10\times10^{-4}$ mol/m$^2$ |
| | solvent (j) | 0.08 |
| The fifth layer (blue-sensitive layer) | emulsion (see Table 3) silver | 0.40 g/m$^2$ |
| | gelatin | 1.35 g/m$^2$ |
| | yellow coupler (k) | $6.91\times10^{-4}$ mol/m$^2$ |
| | color image stabilizer (1) | 0.13 g/m$^2$ |
| | solvent (m) | 0.02 g/m$^2$ |
| | (The nucleating agent is as shown in Table 3) | |
| The fourth layer (U.V. absorbing layer) | gelatin | 1.60 g/m$^2$ |
| | colloidal silver | 0.10 g/m$^2$ |
| | U.V. absorber (h) | $1.70\times10^{-4}$ mol/m$^2$ |
| | color mixing inhibitor (i) | $1.60\times10^{-4}$ mol/m$^2$ |
| | solvent (j) | 0.24 g/m$^2$ |
| The third layer (green-sensitive layer) | emulsion (see Table 3) silver | 0.17 g/m$^2$ |
| | gelatin | 1.56 g/m$^2$ |
| | magenta coupler (e) | $3.38\times10^{-4}$ mol/m$^2$ |
| | color image stabilizer (f) | 0.19 g/m$^2$ |
| | solvent (g) | 0.59 g/m$^2$ |
| | (The nucleating agent is as shown in Table 3) | |
| The second layer (color mixing-inhibiting layer) | gelatin | 0.90 g/m$^2$ |
| | color mixing-inhibitor (d) | $2.33\times10^{-4}$ mol/m$^2$ |
| The first layer (red-sensitive layer) | emulsion (see Table 3) silver | 0.39 g/m$^2$ |
| | gelatin | 0.90 g/m$^2$ |
| | cyan coupler (a) | $7.05\times10^{-4}$ mol/m$^2$ |
| | color image stabilizer (b) | $5.20\times10^{-4}$ mol/m$^2$ |
| | solvent (c) | 0.22 g/m$^2$ |
| | (The nucleating agent is as shown in Table 3) | |
| Support | Polyethylene-laminated paper (containing a white pigment (such as $TiO_2$) and a blue dye (such as ultramarine) in the polyethylene layer adjacent to the first layer) | |

The spectral sensitizers in the respective emulsion layers as follows:

Spectral sensitizers:

blue-sensitive emulsion layer;

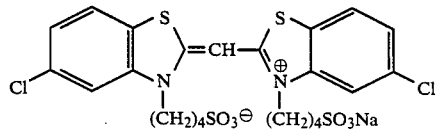

green-sensitive emulsion layer;

-continued
Spectral sensitizers:
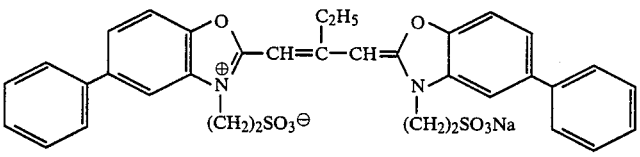
red-sensitive emulsion layer;
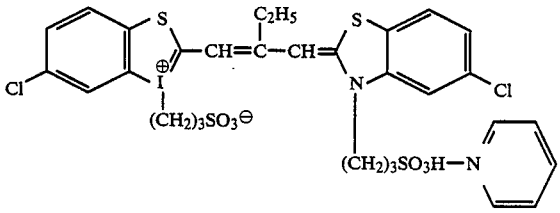
The anti-irradiation dyes in the respective emulsion layers were as follows:
Anti-irradiation dyes:
green-sensitive layer;
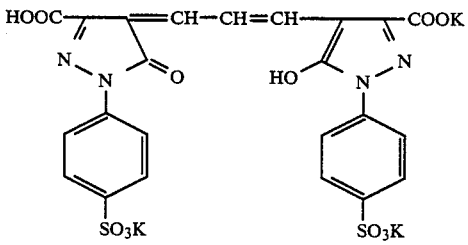
red-sensitive layer;
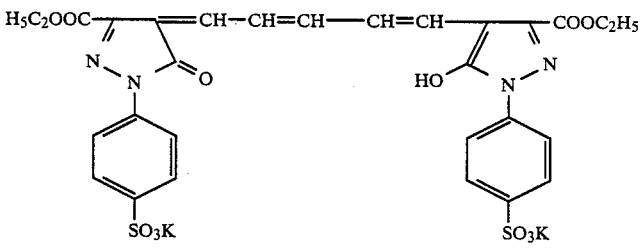
The structural formulae of the componds used as the couplers etc. in this example were as follows:
(k) yellow coupler
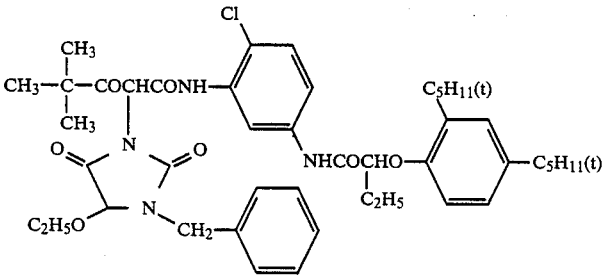
(l) color image-stabilizer -continued
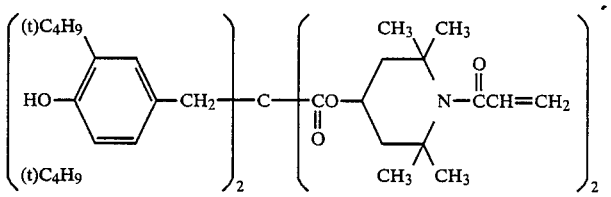
(m) solvent
(iso $C_9H_{19}O)_3P{=}O$
(d) colormixing inhibitor
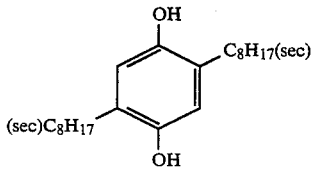
(e) magenta coupler
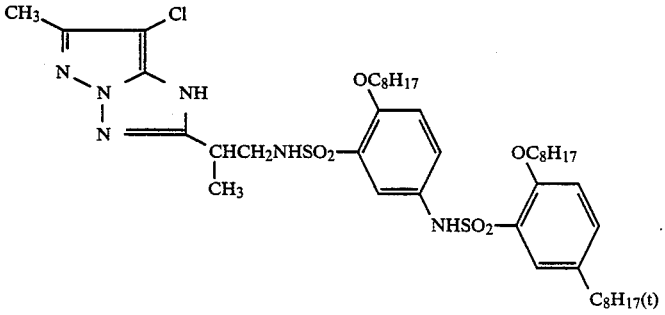
(f) color image stabilizer
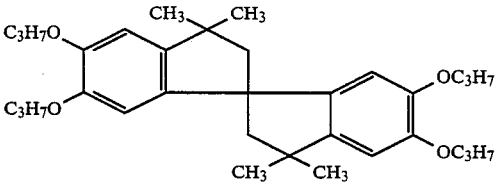
(g) solvent
a mixture of $((n)C_8H_{17}O)_3P{=}O$ and
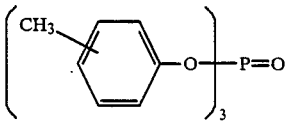
in a weight ratio of 2:1.
(h) U.V. absorber
a mixture of
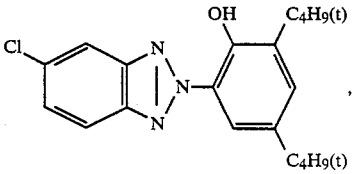

-continued
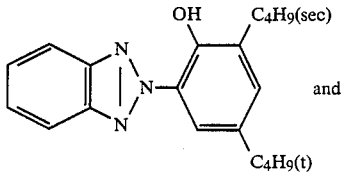
and
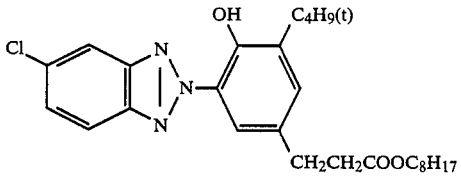
in a molar ratio of 1:5:3
(i) color-mixing inhibitor
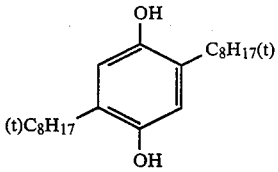
(j) solvent
(iso $C_9H_{19}O)_3P{=}O$
(a) cyan coupler
a mixture of
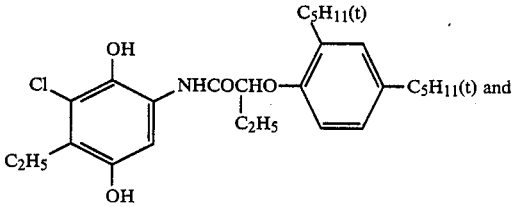
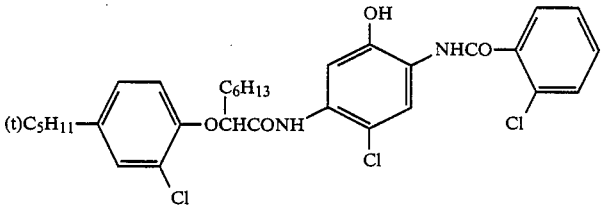
in a molar ratio of 1:1
(b) color image stabilizer
a mixture of
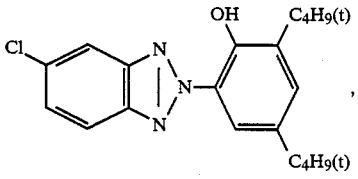
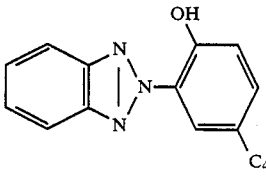
and -continued

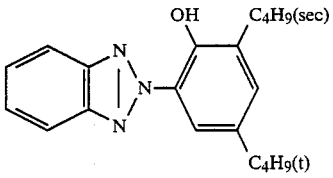

in a molar ratio of 1:3:3

(c) solvent:

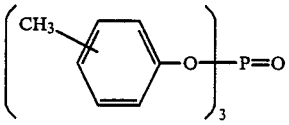

The balance between the surface tension and viscosity of the coating solutions for forming the first layer through the seventh layer was controlled and then the solutions were applied at the same time to form multilayer silver halide color photosensitive material Nos. (1) to (24).

The nucleating agents contained in the photosensitive materials and the amounts thereof incorporated in the emulsion layers are shown in the following Table 3.

The thus prepared direct positive-type silver halide color photosensitive material Nos. (1) to (12) were imagewisely exposed (250 CMS) and then processed according to the following processing step A or B:

Processing step A

| | Time | Temperature | Quantity of replenisher |
|---|---|---|---|
| Color development | 3 min. 15 sec. | 38° C. | 350 ml/m$^2$ |
| Bleach-fixing | 40 sec. | 38° C. | 200 ml/m$^2$ |
| Stabilization (1) | 20 sec. | 38° C. | — |
| Stabilization (2) | 20 sec. | 38° C. | — |
| Stabilization (3) | 20 sec. | 38° C. | 200 ml/m$^2$ |

The stabilization bath was replenished according to a so-called counter current method wherein the replenisher was fed in the stabilizing bath (3), an overflow from the bath (3) was introduced into the stabilizing bath (2) and an overflow from the bath (2) was introduced into the bath (1).

(Color developer) A

| | Mother liquor | Replenisher |
|---|---|---|
| diethylenetriaminepentaacetic acid | 2.0 g | 2.0 g |
| benzyl alcohol | 12.0 g | 14.0 g |
| diethylene glycol | 3.4 g | 4.0 g |
| sodium sulfite | 2.0 g | 2.0 g |
| sodium bromide | 0.26 g | 0.26 g |
| hydroxylamine sulfate | 2.60 g | 3.3 g |
| sodium chloride | 3.20 g | — |
| 3-methyl-4-amino-N-ethyl-N-(β-methanesulfonamidoethyl)aniline | 4.25 g | 6.25 g |
| potassium carbonate | 30.0 g | 25.0 g |
| fluorescent brightening agent (stilbene compound) | 1.0 g | 1.5 g |
| water | ad 1000 ml | ad 1000 ml |
| pH | 10.20 | 10.40 |

The pH was controlled with potassium hydroxide or hydrochloric acid.

(Bleach-fixing solution) A

| | Mother liquor | Replenisher |
|---|---|---|
| ammonium thiosulfate | 110 g | the same as the mother liquor |
| sodium hydrogensulfite | 10 g | |
| iron (III) diethylenetriamine-pentaacetate amonium monohydrate | 56 g | |
| disodium ethylenediaminetetra-acetate dihydrate | 5 g | |
| bleaching accelerator | $5 \times 10^{-3}$ mol | |
| water | ad 1000 ml | |
| pH | 6.5 | |

The pH was controlled with aqueous ammonia or hydrochloric acid.

(Stabilizer A)

| | Mother liquor | Replenisher |
|---|---|---|
| 1-hydroxyethylidene-1,1'-diphosphonic acid (60%) | 1.6 g | the same as the mother liquor |
| bismuth chloride | 0.35 g | |
| polyvinylpyrrolidone | 0.25 g | |
| aqueous ammonia | 2.5 ml | |
| trisodium nitrilotriacetate | 1.0 g | |
| 5-chloro-2-methyl-4-isothiazolin-3-one | 50 mg | |
| 2-octyl-4-isothiazolin-3-one | 50 mg | |
| Fluorescent brightening agent (4,4'-diaminostilbene compound) | 1.0 g | |
| water | ad 1000 ml | |
| pH | 7.5 | |

The pH was adjusted with potassium hydroxide or hydrochloric acid.

Processing step B

| | Time | Temperature | Quantity of replenisher |
|---|---|---|---|
| Color development | 2 min. 30 sec. | 38° C. | 350 ml/m$^2$ |
| Bleach-fixing | 40 sec. | 38° C. | 200 ml/m$^2$ |
| Stabilization (1) | 20 sec. | 38° C. | — |
| Stabilization (2) | 20 sec. | 38° C. | — |
| Stabilization (3) | 20 sec. | 38° C. | 200 ml/m$^2$ |

The stabilizer was replenished according to a so-called counter current method wherein the replenisher was fed to the stabilizing bath (3), an overflow from the (3) was introduced into a stabilizing bath (2) and an overflow from the bath (2) was introduced into the stabilizing bath (1).

| (Color developer) B | | |
|---|---|---|
| | Mother liquor | Replenisher |
| diethylenetriaminepentaacetic acid | 2.0 g | 2.0 g |
| benzyl alcohol | 12.8 g | 14.0 g |
| diethylene glycol | 3.4 g | 4.0 g |
| sodium sulfite | 2.0 g | 2.9 g |
| sodium bromide | 0.26 g | 0.26 g |
| hydroxylamine sulfate | 2.60 g | 3.3 g |
| sodium chloride | 3.20 g | — |
| 3-methyl-4-amino-N-ethyl-N-(β-methanesulfonamidoethyl)aniline | 4.25 g | 6.25 g |
| dipotassium hydrogenphosphate | 25.0 g | 20.0 g |
| fluorescent brightening agent (stilbene compound) | 1.0 g | 1.5 g |
| water | ad 1000 ml | ad 1000 ml |
| pH | 11.50 | 11.70 |

The pH was adjusted with potassium hyroxide or hydrochloric acid.

| (Bleach-fixing solution) B | | |
|---|---|---|
| | Mother liquor | Replenisher |
| ammonium thiosulfate | 110 g | the same as the mother liquor |
| sodium hydrogensulfite | 10 g | |
| iron (III) ethylenediamine-tetraacetate ammonium monohydrate | 40 g | |
| disodium ethylenediaminetetra-acetate dihydrate | 5 g | |
| bleaching accelerator | | $5 \times 10^{-3}$ mol |
| water | ad 1000 ml | |
| pH | 6.5 | |

The pH was adjusted with aqueous ammonia or hydrochloric acid.

| (Stabilizer) | |
|---|---|
| 2Na · EDTA | 0.4 g/l |
| water | ad 1000 ml |
| pH | 7.5 |

The pH was adjusted with sodium hydroxide or hydrochloric acid.

The bleach accelerators used in this example were as follows:

Bleach accelerators:

A

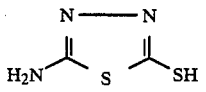

B

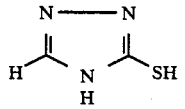

C

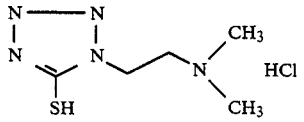

-continued

Bleach accelerators:

D

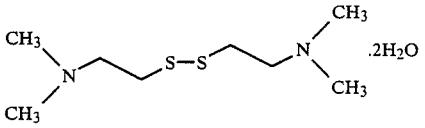

E

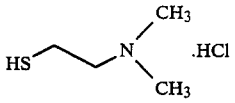

Preparation of Multi-Layer Color Photosensitive Materials Nos. (13) to (24) and Processes Therefor Photosensitive material Nos. (13) to (24) were prepared in the same manner as in the preparation of the multi-layer color photosensitive material Nos. (1) to (12) by using the core/shell-type direct positive emulsions A and B. The layer construction of them are shown in Table 2.

TABLE 2

| Layer | Main composition | Amount |
|---|---|---|
| The seventh layer (protective layer) | gelatin | 1.33 g/m² |
| | acryl-modified polyvinyl alcohol copolymer (degree of modification: 17%) | 0.17 g/m² |
| The sixth layer (U.V.-absorbing layer) | gelatin | 0.54 |
| | U.V. absorber (h) | $5.10 \times 10^{-4}$ mol/m² |
| | solvent (j) | 0.08 |
| The fifth layer (blue-sensitive layer) | emulsion (see Table 3) silver | 0.40 g/m² |
| | gelatin | 1.35 g/m² |
| | yellow coupler (k) | $6.91 \times 10^{-4}$ mol/m² |
| | color image stabilizer (1) | 0.13 g/m² |
| | solvent (m) | 0.02 g/m² |
| | (The nucleating agent was as shown in Table 3) | |
| The fourth layer (U.V.-absorbing layer) | gelatin | 1.60 g/m² |
| | colloidal silver | 0.10 g/m² |
| | U.V. absorber (h) | $1.70 \times 10^{-4}$ mol/m² |
| | color mixing-inhibitor (i) | $1.60 \times 10^{-4}$ mol/m² |
| | solvent (j) | 0.24 g/m² |
| The third layer (green-sensitive layer) | emulsion (see Table 3) silver | 0.39 g/m² |
| | gelatin | |
| | magenta coupler (e) | $4.60 \times 10^{-4}$ mol/m² |
| | color image stabilizer (f) | 0.14 g/m² |
| | solvent (g) | 0.42 g/m² |
| | (The nucleating agent was as shown in Table 3) | |
| The second layer (color mixing-inhibiting layer) | gelatin | 0.90 g/m² |
| | color mixing-inhibitor (d) | $2.33 \times 10^{-4}$ mol/m² |
| The first layer (red-sensitive layer) | emulsion (see Table 3) silver | 0.39 g/m² |
| | gelatin | 0.90 g/m² |
| | cyan coupler (a) | $7.05 \times 10^{-4}$ mol/m² |
| | color image stabilizer (b) | $5.20 \times 10^{-4}$ mol/m² |
| | solvent (c) | 0.22 g/m² |

TABLE 2-continued

| Layer | Main composition | Amount |
|---|---|---|
| | (The nucleating agent was as shown in Table 3) | |
| Support | Paper laminated with polyethylene and containing a white pigment (such as $TiO_2$) and a blue dye (such as ultramarine) in the polyethylene layer adjacent to the first layer | |

The spectral sensitizers contained in the respective emulsion layers were as follows:

blue-sensitive emulsion layer;

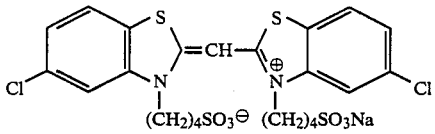

green-sensitive emulsion layer;

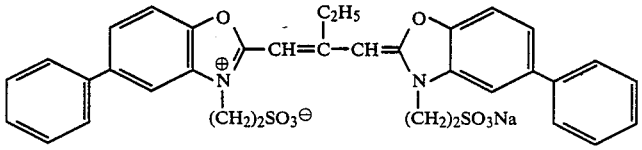

red-sensitive emulsion layer;

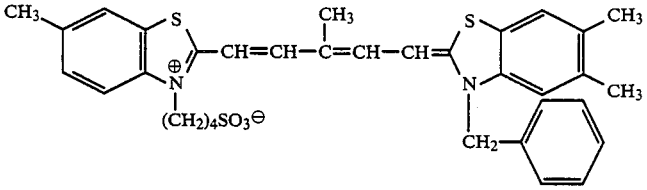

Anti-irradiation dyes contained in the respective emulsion layers were as follows:

green-sensitive emulsion layers;

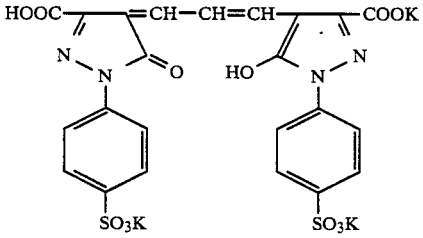

red-sensitive emulsion layers;

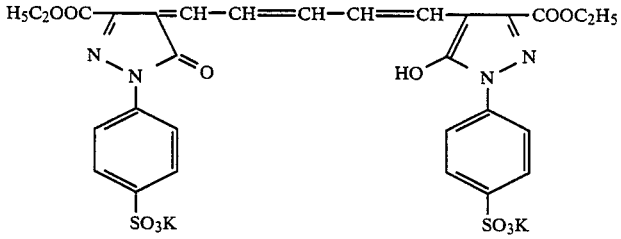

The structural formulae of the compounds contained in the multi-layer color photosensitive materials (13) to (24) were as follows:

(a) yellow coupler

-continued
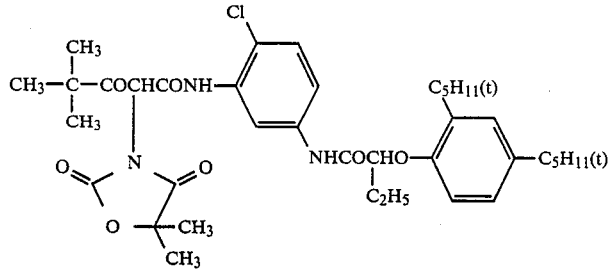
(b) color image stabilizer
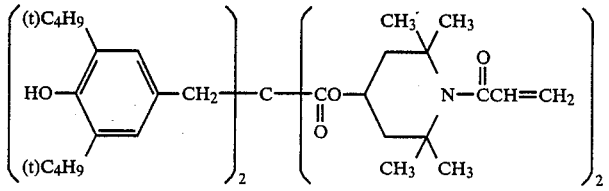
(c) solvent
$(iso C_9H_{19}O)_3P{=}O$
(d) color mixing inhibitor
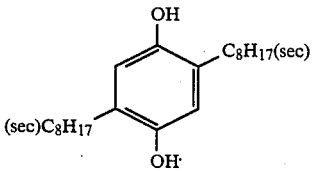
(e) magenta coupler
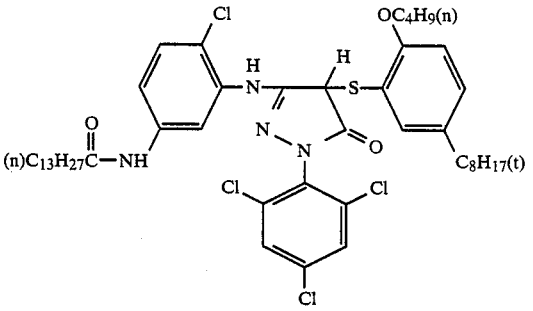
(f) color image stabilizer
a mixture of
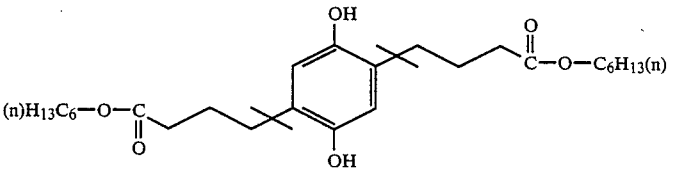
and -continued
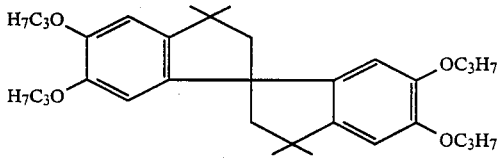
in a weight ratio of 1:1.5
(g) solvent
a mixture of 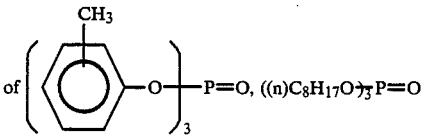
and
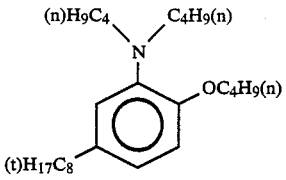
in a weight ratio of 1:2:2
(h) U.V. absorber
a mixture of 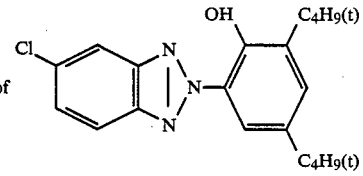
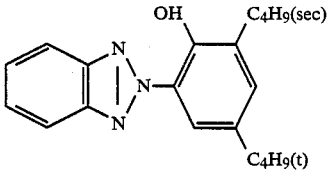
and
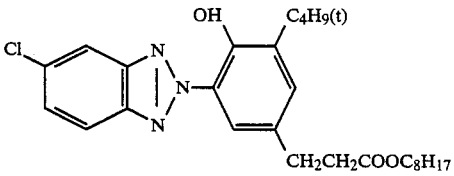
in a weight ratio of 1:5:3
(i) color mixing inhibitor
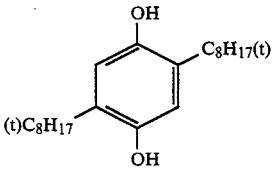
(j) solvent
$(iso C_9H_{19}O)_3P{=}O$ -continued (k) cyan coupler

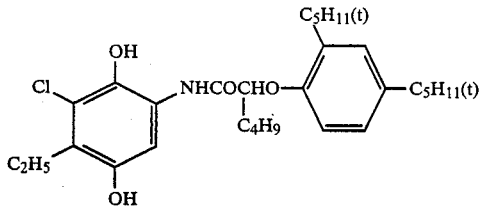

(l) color image stabilizer a mixture of

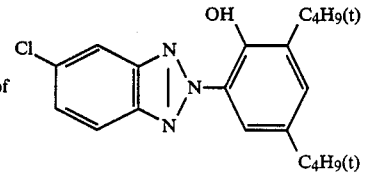

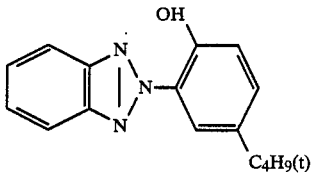

and

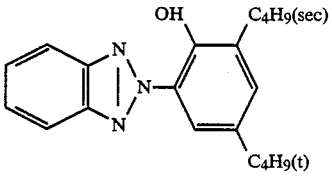

in a weight ratio of 1:3:3

(m) solvent

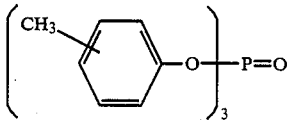

(n) nucleating agent

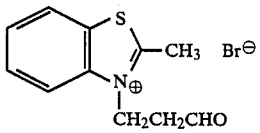

The balance between the surface tension and the viscosity of the coating solutions for forming the first layer through the seventh layer was controlled and then the solutions were applied at the same time to form multi-layer silver halide color photosensitive material Nos. (13) to (24). They were processed in the same manner as in the processing of the multi-layer silver halide color photosensitive materials (1) to (12).

The amount of the remaining silver in the maximum density region of the processed photosensitive material is shown in Table 3. The amount of the remaining silver was determined according to fluorescent X-ray method.

TABLE 3

| Photo-sensitive material No. | Silver halide emulsion BL | GL | RL | Nucleating agent (Compound No.) | Amount of remaining silver ($\mu g/cm^2$) Processing step | No bleach-accelerator | Bleach-accelerator used | |
|---|---|---|---|---|---|---|---|---|
| 1 | B | B | B | 4 | A | 8.3 | A | 3.0 |
| 2 | " | " | " | 20 | A | 6.8 | A | 2.0 |
| 3 | " | " | " | 71 | A | 5.5 | B | 1.0 |
| 4 | A | A | A | 4 | A | 8.2 | B | 1.6 |
| 5 | " | " | " | 20 | A | 7.9 | A | 2.4 |
| 6 | " | " | " | 71 | A | 8.0 | B | 1.8 |
| 7 | B | B | B | 65 | B | 15.3 | A | 3.1 |
| 8 | " | " | " | 43 | B | 15.1 | B | 2.3 |
| 9 | " | " | " | 55 | B | 12.1 | A | 3.3 |
| 10 | A | A | A | 65 | B | 13.3 | B | 2.0 |
| 11 | " | " | " | 43 | B | 14.1 | B | 1.9 |
| 12 | " | " | " | 55 | B | 12.8 | A | 3.3 |
| 13 | B | B | B | 4 | A | 7.6 | B | 1.1 |
| 14 | " | " | " | 20 | A | 7.9 | B | 1.2 |
| 15 | " | " | " | 71 | A | 8.8 | B | 1.5 |
| 16 | D | D | D | 4 | A | 8.2 | B | 1.9 |
| 17 | " | " | " | 20 | A | 9.1 | A | 2.4 |
| 18 | " | " | " | 71 | A | 8.5 | A | 2.7 |
| 19 | G | G | G | 65 | B | 11.3 | B | 1.9 |
| 20 | " | " | " | 43 | B | 10.2 | B | 1.2 |
| 21 | " | " | " | 55 | B | 11.4 | B | 3.0 |
| 22 | D | D | D | 65 | B | 12.3 | B | 2.4 |
| 23 | " | " | " | 43 | B | 10.9 | A | 2.9 |
| 24 | " | " | " | 55 | B | 12.8 | B | 3.5 |

Amount of the nucleating agent:

$2.5\times10^{-6}$ mol/mol-AgX for Compound Nos. 4 and 20, and $3.5\times10^{-5}$ mol/mol-AgX for Compound Nos. 43, 55, 65 and 71.

It is apparent from Table 3 that the amount of the remaining silver could be reduced remarkably by incorporating the bleach-accelerator in the bleaching bath. When the pH of the color developer used in the previous bath of the bleach-fixing bath was high and iron (III) complex salt of ethylenediaminetetraacetic acid was used as the bleaching agent, the pH of the color developer was low and the amount of the remaining silver was slightly larger than that observed when diethylenetriaminepentaacetic acid was used as the bleaching agent.

EXAMPLE 2

Photosensitive material Nos. 25 to 28 were prepared in the same manner as in the preparation of the direct positive-type silver halide color photosensitive material Nos. 1 to 3 in Example 1 except that the support was replaced with a transparent triacetylcellulose support and that the coating amounts of the emulsions were increased to 3-folds. The photosensitive materials were processed according to the following steps:

Processing step C

| | Time | Temperature | Quantity of replenisher |
|---|---|---|---|
| Color development | 2 min. 30 sec. | 38° C. | 700 ml/m² |
| Bleaching | 1 min. | 38° C. | 200 ml/m² |
| Fixing | 1 min. | 38° C. | 500 ml/m² |
| Stabilization (1) | 20 sec. | 38° C. | — |
| Stabilization (2) | 20 sec. | 38° C. | — |
| Stabilization (3) | 20 sec. | 38° C. | 200 ml/m² |

The stabilization bath was replenished according to a so-called counter current method wherein the replenisher was fed in the stabilizing bath (3), an overflow from the bath (3) was introduced into the stabilizing bath (2) and an overflow from the bath (2) was introduced into the bath (1).

(Color developer) C

| | Mother liquor | Replenisher |
|---|---|---|
| diethylenetriaminepentaacetic acid | 2.0 g | 2.0 g |
| triethanolamine | 8.5 g | 8.5 g |
| diethylhydroxylamine | 2.4 g | 2.4 g |
| sodium sulfite | 0.13 g | 0.13 g |
| sodium bromide | 0.26 g | 0.26 g |
| 3-methyl-4-amino-N-ethyl-N-(β-methanesulfonamidoethyl)aniline | 5.0 g | 7.0 g |
| potassium carbonate | 25 g | 25 g |
| pH | 10.20 | 10.40 |

(Bleaching solution) (C)

| | |
|---|---|
| iron (III) ethylenediaminetetraacetate | 0.25 mol |
| sodium ethylenediaminetetraacetate | 10 g |
| bleaching accelerator | $5\times10^{-3}$ mol |
| ammonium bromide | 160 g |
| water | ad 1000 ml |
| pH | 6.0 |

The pH was adjusted with hydrochloric acid or ammonia.

(Fixing solution) (C)

| | |
|---|---|
| ammonium thiosulfate | 160 g |
| sodium hydrogensulfite | 12 g |
| disodium ethylenediaminetetraacetate | 5 g |
| water | ad 1000 ml |
| pH | 7.2 |

(Stabilizer) (C)

| | |
|---|---|
| 2Na · EDTA | 0.4 g/l |
| water | ad 1000 ml |
| pH | 7.5 |

The pH was adjusted with sodium hydroxide or hydrochloric acid.

Processing Step D

The processing was conducted in the same manner as in the processing step C except that iron (III) ethylenediaminetetraacetate contained in the bleaching solution as the blealching agent was replaced with iron (III) cyclohexanediaminetetraacetate.

Processing Step E

The processing was conducted in the same manner as in the processing step C except that the bleaching agent in the bleaching solution was replaced with iron (III) 1,3-diaminopropanetetraacetate.

The results are shown in Table 4.

TABLE 4

| Photo-sensitive material No. | Silver halide emulsion BL | GL | RL | Nucleating agent (Compound No.) | Processing step | Amount of remaining silver ($\mu g/cm^2$) No accelerator | Bleach-agent | Accelerator used |
|---|---|---|---|---|---|---|---|---|
| 25 | B | B | B | 65 | C | 20.3 | D | 1.8 |
| 25 | " | " | " | 65 | D | 6.2 | D | 1.1 |
| 25 | " | " | " | 65 | E | 4.1 | D | 1.0 |
| 26 | B | B | B | 50 | C | 25.3 | C | 1.2 |
| 26 | " | " | " | 50 | D | 7.1 | C | 0.9 |
| 26 | " | " | " | 50 | E | 4.5 | C | 0.8 |
| 27 | A | A | A | 65 | C | 22.5 | E | 1.3 |
| 27 | " | " | " | 65 | D | 5.6 | E | 0.7 |
| 27 | " | " | " | 65 | E | 3.3 | E | 0.5 |
| 28 | A | A | A | 50 | C | 23.3 | D | 1.9 |
| 28 | " | " | " | 50 | D | 6.7 | D | 0.8 |
| 28 | " | " | " | 50 | E | 2.9 | D | 0.4 |

It is apparent from Table 4 that the amount of silver remaining in the processed photosensitive material was reduced by adding the bleaching accelerator to the bleaching solution in all of the processing steps C, D and E. It is interesting that when the photosensitive materials were processed with the bleaching solution free of bleaching accelerator, the amount of the remaining silver was reduced in order of the processing C, D and E. Supposedly, this fact indicates that the bleaching capacities of the bleaching agents in the respective steps were increased in order of iron (III) ethylenediaminetetraacetic cyclohexanediaminetetraacetic acid and 1,3-diaminopropanetetraacetic acid.

EXAMPLE 3

Multi-layer color photosensitive materials 29 to 32 were prepared in the same manner as in the preparation of the multi-layer color photosensitive material No. 4 in Example 1 by using the internal latent image-type silver halide emulsion A except that no nucleating agent was used.

The multi-layer color photosensitive materials were imagewisely exposed and then processed according to the processing step A or B. In this process, 15 sec. after the initiation of the color development, the photosensitive material was exposed to light of 0.5 lux (color temperature: 5400 K) for 10 sec. and the amount of the remaining silver in the processed sample was determined. The results are shown in the following Table 5.

TABLE 5

| Multi-layer color photo-sensitive material | Emul-sion | Proces-sing step | Among of the remaining silver ($\mu g/cm^2$) No accel-erator | Bleaching agent | Accelerator used |
|---|---|---|---|---|---|
| 29 | A | A | 6.0 | A | 3.0 |
| 30 | A | A | 6.0 | B | 2.0 |
| 31 | A | B | 9.2 | A | 3.2 |
| 32 | A | B | 9.2 | B | 2.4 |

It is apparent from Table 5 that also in the light fog process, the amount of the remaining silver was remarkably reduced by using the bleaching accelerator.

What is claimed is:

1. A process for forming a direct positive color image comprising (i) exposing a photosensitive material comprising, on a support, at least one photographic emulsion layer containing previously unfogged internal latent image-type silver halide grains and a color image-forming coupler, (ii) color-developing the material with a color developer having a pH of 11.5 or lower in the presence of a nucleating agent, and then (iii) processing the material with a processing solution having a bleaching effect, wherein said process a bleaching accelerator is incorporated into a bath containing the processing solution having the bleaching effect, or into a pre-processing bath, or said bleaching accelerator is incorporated into the photosensitive material, and wherein the bleaching accelerator is a compound selected from those represented by the following general formulae:

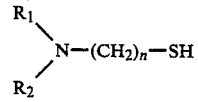

(I)

wherein $R_1$ and $R_2$ may be the same or different and each represents a hydrogen atom or a substituted or unsubstituted lower alkyl group or acyl group and n represents an integer of 1 to 3 and $R_1$ and $R_2$ may be combined to form a ring,

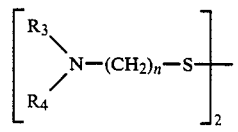

(II)

wherein $R_3$ and $R_4$ have the same meanings as those of $R_1$ and $R_2$ in general formula (I), n represents an integer of 1 to 3, and $R_3$ and $R_4$ may be combined to form a ring,

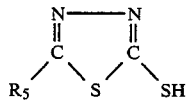
(III)

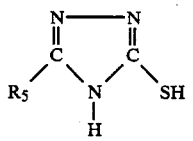
(IV)

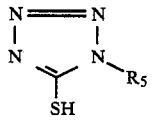
(V)

wherein $R_5$ represents a hydrogen atom, halogen atom, amino group, substituted or unsubstituted alkyl group, or amino group having an alkyl group,

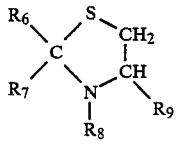
(VI)

wherein $R_6$ and $R_7$ may be the same or different and each represents a hydrogen atom, substituted or unsubstituted alkyl group, substituted or unsubstituted phenyl group, or substituted or unsubstituted heterocyclic group, $R_8$ represents a hydrogen atom or a substituted or unsubstituted lower alkyl group, and $R_9$ represents a hydrogen atom or carboxyl group, and

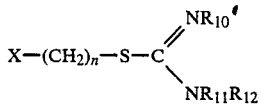
(VII)

wherein $R_{10}$, $R_{11}$ and $R_{12}$ may be the same or different and each represents a hydrogen atom or lower alkyl group, $R_{10}$ and $R_{11}$ or $R_{12}$ may be combined to form a ring, and X represents a substituted or unsubstituted amino group, sulfonic acid group or carboxyl group.

2. The process of claim 1 wherein said bleaching accelerator is used in an amount of $1\times10^{-5}$–$10^{-1}$ mol/-liter of the processing solution.

3. The process of claim 2 wherein said amount is $1\times10^{-4}$–$5\times10^{-2}$ mol/liter of the processing solution.

4. The process of claim 1 wherein the processing solution having the bleaching effect is a bleach-fixing solution.

5. The process of claim 1 wherein said color image-forming coupler provides a dye which is formed or released by the oxidation coupling with a color developing agent, said color image-forming coupler per se being substantially non-diffusible, and said dye being non-diffusible.

6. The process of claim 1 wherein said previously unfogged internal latent image-type silver halide grain is of core/shell-type.

* * * * *